US006738596B2

(12) United States Patent
Kamimura et al.

(10) Patent No.: US 6,738,596 B2
(45) Date of Patent: May 18, 2004

(54) IMAGE FORMING DEVICE REGULATING SHEET CONVEYING TIMINGS

(75) Inventors: Masahiro Kamimura, Nagoya (JP); Kazumasa Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/298,821

(22) Filed: Nov. 19, 2002

(65) Prior Publication Data

US 2003/0095822 A1 May 22, 2003

(30) Foreign Application Priority Data

Nov. 20, 2001 (JP) ..... 2001-354903
Dec. 20, 2001 (JP) ..... 2001-387834

(51) Int. Cl.[7] ..... G03G 15/00
(52) U.S. Cl. ..... 399/396
(58) Field of Search ..... 399/388, 389, 399/393, 394, 396; 271/10.13

(56) References Cited

U.S. PATENT DOCUMENTS 5,878,321 A * 3/1999 Miyazaki et al. ..... 399/388
6,311,039 B1 * 10/2001 Funamizu et al. ..... 399/394
6,397,035 B2 * 5/2002 Kataoka et al. ..... 399/388

FOREIGN PATENT DOCUMENTS

JP A 59-221785 12/1984
JP A 4-275564 10/1992
JP 04275564 A * 10/1992 ..... G03G/15/00
JP A 10-35941 2/1998

* cited by examiner

*Primary Examiner*—Susan S. Y. Lee
*Assistant Examiner*—Ryan Gleitz
(74) *Attorney, Agent, or Firm*—Oliff & Berridge, PLC

(57) ABSTRACT

An image forming device having a sheet conveying path extending from a feeder unit to an image forming unit. A convey roller positioned downstream of the sheet supply roller is rotated at a peripheral speed V3. Additional convey roller positioned downstream of the first convey roller is rotated at a peripheral speed V2 lower than V3. A register roller positioned downstream of the second convey roller is rotated at a peripheral speed V1 lower than V2. A transfer roller of the image forming unit is rotated at a peripheral speed V0 lower than V1. Each convey roller, the register roller, the sheet supply roller is connected to each clutch. Sheet sensors are provided between neighboring rollers for detecting a leading edge of the sheet. Upon detection of the leading edge, the roller positioned immediately upstream of the one of the sensors is shifted to its non-driving state.

12 Claims, 12 Drawing Sheets

IMAGE FORMING DEVICE REGULATING SHEET CONVEYING TIMINGS

BACKGROUND OF THE INVENTION

The present invention relates to an electrophotographic type image forming device used in laser printers, photocopiers, facsimile machines, and the like.

A conventional electrophotographic type image forming device, such as a laser printer, has been disclosed, for example, in laid open Japanese patent application publication No. HEI-10-35941. In this type of image forming device, a toner image formed on a photosensitive drum is transferred to a sheet or another recording medium as the medium passes between a transfer roller and the photosensitive drum. Subsequently, the recording medium passes between a single heat roller and a single pressure roller, causing the toner to melt by heat and fixing the toner image to the surface of the recording medium. A sheet supply unit is provided for supplying the recording medium stacked in a sheet supply tray, one sheet at a time. The sheet of the recording medium is conveyed from the sheet supply unit to an image forming section at which the photosensitive drum opposes the transfer roller through a conveying path by a sheet supply roller, a plurality of intermediate conveying rollers, and a register roller provided along the conveying path. The register roller is intermittently driven while the plurality of intermediate conveying rollers are rotated. A leading edge of the image recording medium abuts against the stopped register roller while the medium is fed by the conveying rollers, so that an intermediate area of the recording medium can be flexed. As a result, the leading edge can be aligned with a proper orientation, while the supply timing of the medium to the image forming section can be adjusted.

When forming images on a plurality of recording mediums in succession, the start timing for supplying the second and subsequent sheets from the sheet supply unit is set as follows. If the trailing edge of the preceding sheet is too close to the leading edge of the following sheet, a leading edge of a subsequent sheet may reach a sheet sensor disposed along the conveying path from the sheet supply unit to a discharging unit prior to the detection of completion of passing of the precedent sheet through the sheet sensor due to unevenness of leading edge positions of the sheets in the sheet supply tray. In the latter case, judgment is made such that the precedent sheet is not subject to feeding but staying at the sheet sensor position, and accordingly, an error processing attendant to sheet jamming is improperly executed.

If the subsequent sheet is fed prior to the separation of the trailing edge of the precedent sheet from the sheet supply roller, unwanted force is applied to the precedent sheet, which degrades sheet conveying performance. To avoid this problem, normally, the start timing for supplying sheets is set such that an interval of a prescribed amount, for example approximately 60 mm, is provided between the trailing edge of the preceding sheet and the leading edge of the following sheet taking also image data developing period into consideration.

For supplying each one sheet from the sheet supply unit, a frictional separating mechanism is used for separating the one sheet from the remaining sheet stack. One such frictional separating mechanism employs a separation pad pressing against the sheet supply roller to generate friction for separating the sheets. However, sometimes the leading edges of the sheets in the sheet supply unit become uneven, when using such frictional separating mechanism, a following sheet can oppose the frictional force between the sheet supply roller and frictional separating pad and move in the conveying direction as the preceding sheet is conveyed due to attractive force between the preceding uppermost sheet and the subsequent lower sheet stacked in the sheet supply tray. In this case, the subsequent sheet stops with its leading edge shifted downstream in the conveying direction from a reference position at the nip area between the sheet supply roller and frictional separating pad when the sheet supply roller has stopped.

If the following sheet stops with its leading edge shifted too far downstream from the reference point at the nip area when the sheet supply roller stops, the required condition of maintaining a prescribed interval between neighboring sheets cannot be met. Hence, when the sheet supply roller is driven to rotate at a prescribed timing designed to maintain a prescribed interval between sheets, it is possible that the sheet sensors will detect a sheet jam or that sufficient time is not allocated for developing the image data to be printed.

SUMMARY OF THE INVENTION

The present invention provides an image forming device for forming an image on a cut image recording medium including a drive source, a sheet feeder unit, an image forming unit, a conveying path, and at least two sheet conveying units. The sheet feeder unit stores therein a stack of image recording mediums. At the image forming unit a visible image is formed on the image recording medium. The conveying path extends between the sheet feeder unit and the image forming unit. Each image recording medium is conveyed through the conveying path in a conveying direction from the sheet feeder unit to the image forming unit. The at least two sheet conveying units are connected to the drive source and include a downstream side conveying unit and an upstream side conveying unit. The downstream side conveying unit is disposed along the conveying path for conveying the image recording medium at a first conveying speed. The upstream side conveying unit is disposed along the conveying path and an upstream of the downstream side conveying unit in the conveying direction for conveying the image recording medium at a second conveying speed higher than the first conveying speed.

In one embodiment, the image forming device further includes at least two clutches including a first clutch and a second clutch, and a controller. The first clutch is connected between the drive source and the downstream side sheet conveying unit and provides a power connection state for driving the downstream side conveying unit and a power disconnection state for shutting off power transmission to the downstream side conveying unit. The second clutch is connected between the drive source and the upstream side sheet conveying unit and provides a power connection state for driving the upstream side conveying unit and a power disconnection state for shutting off power transmission to the upstream side conveying unit. The controller controls the at least two clutches so as to provide the disconnection state in the upstream side conveying unit when the downstream side sheet conveying unit holds a leading edge portion of the image recording medium.

In another aspect of the invention, there is provided an image forming device for forming an image on a cut image recording medium including a drive source providing a driving force, a sheet feeder, an image forming unit, a conveying path, a first sheet conveying roller, a first clutch, second clutch, and a controller. The sheet feeder unit includes a sheet storing portion in which a plurality of image recording mediums are stacked in a sheet stack. The sheet supply roller is adapted for separating one image recording medium from a remaining sheet stack and for feeding the separated image recording medium in a sheet feeding direction. At the image forming unit a visible image is formed on the image recording medium. The image forming unit includes a photosensitive member carrying an electrostatic latent image where developing agents are carried as a developing agent image, and a transfer roller for transferring the developing agent image onto the image recording medium. The conveying path extends between the sheet feeder unit and the image forming unit. Each image recording medium is conveyed through the conveying path in the sheet feeding direction from the sheet feeder unit to the image forming unit. The first sheet conveying roller is disposed along the conveying path and between the sheet supply roller and the transfer roller. The first sheet conveying roller provides a peripheral speed lower than that of the sheet supply roller and higher than that of the transfer roller. The first clutch is connected to the first sheet conveying roller for selectively transmitting the driving force of the power source to the first sheet conveying roller. The first clutch provides power connection phase for driving the first sheet conveying roller and provides a power disconnection phase for stopping the first sheet conveying roller. The second clutch is connected to the sheet supply roller for selectively transmitting the driving force of the power source to the sheet supply roller. The controller includes shut-off means, and drive start means. The shut-off means provides the power disconnection phase after a trailing edge of a precedent image recording medium is moved past the first sheet conveying roller, so that a leading edge of a subsequent image recording medium abuts the stopped first sheet conveying roller for regulating an interval between the trailing edge of the precedent sheet and the leading edge of the subsequent sheet. The drive start means provides the power connection phase of the first clutch for starting driving rotation of the first sheet conveying roller after the regulation of the interval.

In still another aspect of the invention, there is provided an image forming device for forming an image on a cut image recording medium including a sheet feeder unit, an image forming unit, a conveying path and a sheet leading edge position regulating unit. The sheet feeder unit stores therein a stack of image recording mediums, and includes a separation unit that intermittently separates one sheet of the stack from a remaining stack at a separating position and feeds the one sheet in a sheet feeding direction. At the image forming unit a visible image is formed on the image recording medium fed from the sheet feeder. The conveying path extends between the sheet feeder unit and the image forming unit. Each image recording medium is conveyed through the conveying path in the sheet feeding direction from the sheet feeder unit to the image forming unit. The sheet leading edge position regulating unit has a part selectively protrudable, near the separating position, into the sheet conveying path to provide a protruding position and selectively retractable away from the sheet conveying path to provide a retracting position. A leading edge position of the image recording medium is regulated upon protrusion of the part into the sheet conveying path.

BRIEF DESCRIPTION OF THE DRAWINGS

In the drawings;

FIG. 11(*b*) is a plan view showing geometrical positions of a pair of sheet leading edge regulating units according to the third embodiment;

DETAILED DESCRIPTION OF THE PREFERRED EMBODIMENTS

Figure 1:
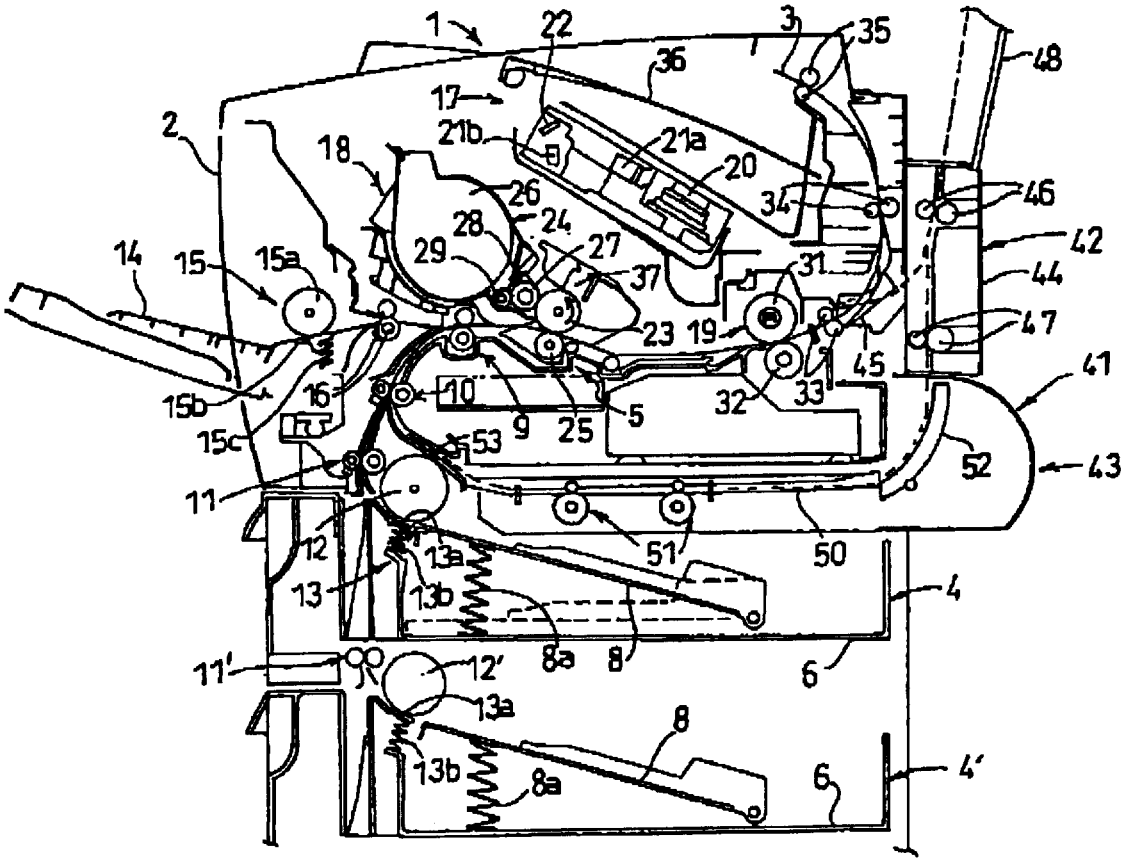
FIG. 1 is a side cross-sectional view showing the general construction of a laser printer according to the first embodiment of the present invention.

An image forming device according to a first embodiment of the present invention will be described with reference to FIGS. 1 through 8. The following description pertains to a laser printer 1 embodying the invention. As shown in FIG. 1, the laser printer 1 includes a main case 2. The main case 2 accommodates a plurality of feeder units 4 for supplying a sheet 3 serving as the recording medium, an image forming unit 5 for forming prescribed images on the sheet 3 fed from the feeder units 4, and a fixing unit 19 for fixing the image onto the sheet.

Each feeder unit 4 is provided with a sheet supply tray 6 detachably mounted on the bottom of the main case 2, a sheet pressure plate 8 provided inside the sheet supply tray 6, and a sheet supply roller 12 and separation pad 13 disposed at the top and on one end of the sheet supply tray 6. A conveying path 7 via which the sheet 3 is conveyed from the sheet supply roller 12 to an image forming position (the point of contact between a photosensitive drum 23 and a transfer roller 25, that is, the transfer position) is formed in a curve as shown in FIG. 1. Provided at suitable intervals along the conveying path 7, beginning in order from the upstream end, are the sheet supply roller 12 serving as a fourth conveying unit, a pair of intermediate conveying rollers 11 serving as third conveying unit and a pair of intermediate conveying rollers 10 serving as second conveying unit, and a register roller 9 serving as first conveying unit disposed just prior to the image forming position and downstream from the intermediate conveying rollers 10 in the conveying direction.

The end of the pressure plate 8 farthest from the sheet supply roller 12 is pivotably supported, enabling the end nearest the sheet supply roller 12 to move up and down. A spring 8*a* disposed on the underside of the pressure plate 8 urges the free end of the pressure plate 8 upward. The sheet supply roller 12 and separating pad 13 are disposed in opposition to each other. The separating pad 13 includes a pad support 13*c*, a spring 13*b* disposed on the underside of the pad support 13*c*, and a separating pad 13*a* provided with a large coefficient of friction that applies pressure on the sheet supply roller 12 through the urging force of the spring 13*b*. Abutment position between the sheet supply roller 12 and the separation pad 13*a* functions as a sheet supply position.

The widthwise dimensions of the separating pad 13*a* and sheet supply roller 12 in the direction orthogonal to the conveying direction are shorter than the width dimension of the sheet 3. When the sheet 3 is conveyed, the separating pad 13*a* and the sheet supply roller 12 contact only approximately the widthwise center of the sheet 3.

The uppermost sheet among the sheet 3 stacked on the pressure plate 8 is pressed against the sheet supply roller 12. The rotations of the sheet supply roller 12 cause a single sheet on top of the stack to be introduced between the sheet supply roller 12 and separating pad 13 one at a time. The single sheet 3 interposed between the sheet supply roller 12 and separating pad 13 is then conveyed by the intermediate conveying rollers 11 to the intermediate conveying rollers 10 and register roller 9 in order. After being properly registered by the register roller 9, the sheet 3 is conveyed to the image forming position.

Provided on one side of the main case 2 at a position above the top feeder unit 4 are a multipurpose tray 14 for supplying the sheet 3 by hand and a multipurpose sheet supply unit 15. The unit 15 includes a multipurpose sheet supply roller 15*a*, a multipurpose pad 15*b* for feeding the sheet 3 stacked in the multipurpose tray 14, and a spring 15*c*. The spring 15*c* is disposed on the underside of the multipurpose pad 15*b* for urging the multipurpose pad 15*b* toward the multipurpose sheet supply roller 15*a*. When a sheet of the sheet 3 stacked on the multipurpose tray 14 is introduced between the rotating multipurpose sheet supply roller 15*a* and the multipurpose pad 15*b*, a single sheet is conveyed to the register roller 9 via a pair of conveying rollers 16.

The image forming unit 5 is provided with a scanning unit 17, a processing unit 18, and a fixing unit 19. The scanning unit 17 is disposed in the top portion of the main case 2 beneath a discharge tray 36. The scanning unit 17 includes a laser light emitting unit (not shown), a rotatably driven polygon mirror 20, lenses 21*a* and 21*b*, and a reflecting mirror 22. A laser beam emitted from the laser light emitting unit based on prescribed image data passes through or is reflected by the polygon mirror 20, lens 21*a*, reflecting mirror 22, and lens 21*b* in order. The resulting light is irradiated in a high-speed scan onto the surface of the photosensitive drum 23, serving as the photosensitive member (image-bearing member) in the processing unit 18.

The processing unit 18 includes a drum cartridge and a developing cartridge 24. The drum cartridge assembles therein the photosensitive drum 23 serving as a photosensitive member, a scorotoron charger 37, and a transfer roller 35 serving as transfer means. The developing cartridge 24 is detachably mounted on the drum cartridge. The developing cartridge 24 includes a toner accommodating unit 26, a developing roller 27 serving as developing means, a toner thickness regulating blade 28, and a toner supply roller 29.

The toner accommodating unit 26 is filled with a developing agent, which in the present embodiment is a positively chargeable, nonmagnetic, single-component polymer toner. The toner is supplied to the developing roller 27 by the toner supply roller 29, and is positively charged through friction generated between the toner supply roller 29 and developing roller 27. As the developing roller 27 rotates, the toner carried on the developing roller 27 Is scraped by the toner thickness regulating blade 28, thereby forming a thin layer of toner having uniform thickness on the surface of the developing roller 27. The rotating photosensitive drum 23 is disposed in opposition to the developing roller 27 and is grounded. The surface of the photosensitive drum 23 has a positively chargeable photosensitive layer formed of polycarbonate or another organic photosensitive material.

In this type of laser printer 1, residual toner remaining on the surface of the photosensitive drum 23 is recovered by the developing roller 27, after the toner image is transferred to the sheet 3 from the photosensitive drum 23 by the transfer roller 25. This toner collection is so called a cleanerless system. By recovering residual toner on the surface of the photosensitive drum 23 using this cleanerless system, it is not necessary to provide a blade or other cleaning device nor a storage device for collecting discarded toner, thereby simplifying the construction of the device and facilitating size and cost reductions.

The scorotoron charger 37 is disposed above the photosensitive drum 23 and is spaced away therefrom a prescribed distance so as not to contact the surface of the same. The scorotoron charger 37 is a positive charging scorotoron charger having a charging wire formed of tungsten or the like from which a corona discharge is generated. The scorotoron charger 37 is configured to charge the entire surface of the photosensitive drum 23 with a uniform positive polarity.

As the photosensitive drum 23 rotates, the scorotron charger 37 generates a positive charge across the entire surface of the photosensitive drum 23. Subsequently, the surface of the photosensitive drum 23 is exposed to the high-speed scanning of a laser beam emitted from the scanning unit 17, forming an electrostatic latent image on the surface based on prescribed image data.

Next, the positively charged toner carried on the surface of the developing roller 27 is brought into contact with the photosensitive drum 23 as the developing roller 27 rotates. At this time, the electrostatic latent images formed on the surface of the photosensitive drum 23 are transformed into visible images when the toner is selectively attracted to portions of the photosensitive drum 23 that were exposed to the laser beam and, therefore, have a lower potential than the rest of the uniformly charged surface. In this way, a reverse image (toner image) is formed.

The transfer roller 25 is disposed below the photosensitive drum 23 and in opposition thereto and is rotatably supported on the drum cartridge to rotate in the clockwise direction of FIG. 1. The transfer roller 25 includes a metal roller shaft covered by a roller that is formed of a rubber material having ionic conductivity. A transfer bias applying power source is configured to apply a forward bias voltage to the transfer roller 25 during image transfers. As a result, the visible image (toner image) carried on the surface of the photosensitive drum 23 is transferred to the sheet 3 as the sheet 3 passes between the photosensitive drum 23 and transfer roller 25.

Next, as shown in FIG. 1, the fixing unit 19 is disposed to the side of and downstream from the processing unit 18. The fixing unit 19 includes a single heat roller 31, a pressure roller 32 applying pressure to the single heat roller 31, and a pair of conveying rollers 33 disposed downstream from the single heat roller 31 and pressure roller 32. The single heat roller 31 is formed of aluminum or another metallic material and is provided with a halogen lamp or other heater. The heat from the single heat roller 31 fixes the toner transferred to the sheet 3 in the processing unit 18 to the sheet 3 as the sheet 3 passes between the single heat roller 31 and the pressure roller 32. Subsequently, the sheet 3 is conveyed by the conveying rollers 33, a pair of conveying rollers 34, and a pair of discharge rollers 35 on the sheet discharge end of the conveying path and is discharged onto the discharge tray 36.

In the present embodiment, the laser printer 1 is provided with a reconveying unit 41 for forming images on the backside of the sheet 3. The reconveying unit 41 is integrally configured of a reversing mechanism 42 and a reconveying tray 43. The reversing mechanism 42 is attached to the back end of the main case 2, while the reconveying tray 43 is detachably mounted in the main case 2 and is insertable over the top feeder unit 4.

The reversing mechanism 42 includes a casing 44 having a substantially rectangular cross-section. The casing 44 is mounted on the outside of the back panel of the main case 2. The reversing mechanism 42 also includes a flapper 45, a pair of reverse rollers 46, and a pair of reconveying rollers 47 disposed inside the casing 44. A reverse guide plate 48 protrudes upward from the top end of the casing 44. The reconeying unit 41 also includes a tray 50, skewed rollers 51, a curved guide plate 52 and a reconveying guide plate 53.

The flapper 45 is pivotally movably provided near to and downstream from the conveying rollers 33 in the back of the main case 2. Upon energization or deenergization of an electromagnetic solenoid (not shown), the sheet 3 having an image formed on one side surface and conveyed by the conveying rollers 33 can be selectively guided toward either the conveying rollers 34 or the reverse rollers 46. When discharging the sheet 3 printed on one side to the discharge tray 36, the flapper 45 is pivotally moved upward. When printing both sides of the sheet 3, the flapper 45 is pivotally moved toward the reverse rollers 46. The reverse rollers 46 are capable of rotating both forward and backward. When the sheet 3 is interposed between the pair of reverse rollers 46, the reverse rollers 46 are first rotated in the forward directions conveying the sheet 3 toward the reverse guide plate 48. Subsequently, the sheet 3 is conveyed backward to the reconveying rollers 47 by the reverse rotation of the reverse rollers 46. The reconveying rollers 47 convey the sheet 3 down a curved guide plate 52 in the reconveying tray 43 and onto the tray 50. The skewed rollers 51 on top of the tray 50 convey the sheet 3 along the tray 50, while maintaining the side edge of the sheet 3 in contact with an aligning plate (not shown). The sheet 3 is conveyed via the reconveying guide plate 53 back to the intermediate conveying roller 10. Through this process, the sheet 3 is reversed such that its unprinted surface is facing up at the location of the intermediate conveying rollers 10 and the register roller 9. Hence, as the sheet 3 passes by the image forming position, images can be formed on the back side of the sheet 3.

Figure 2:
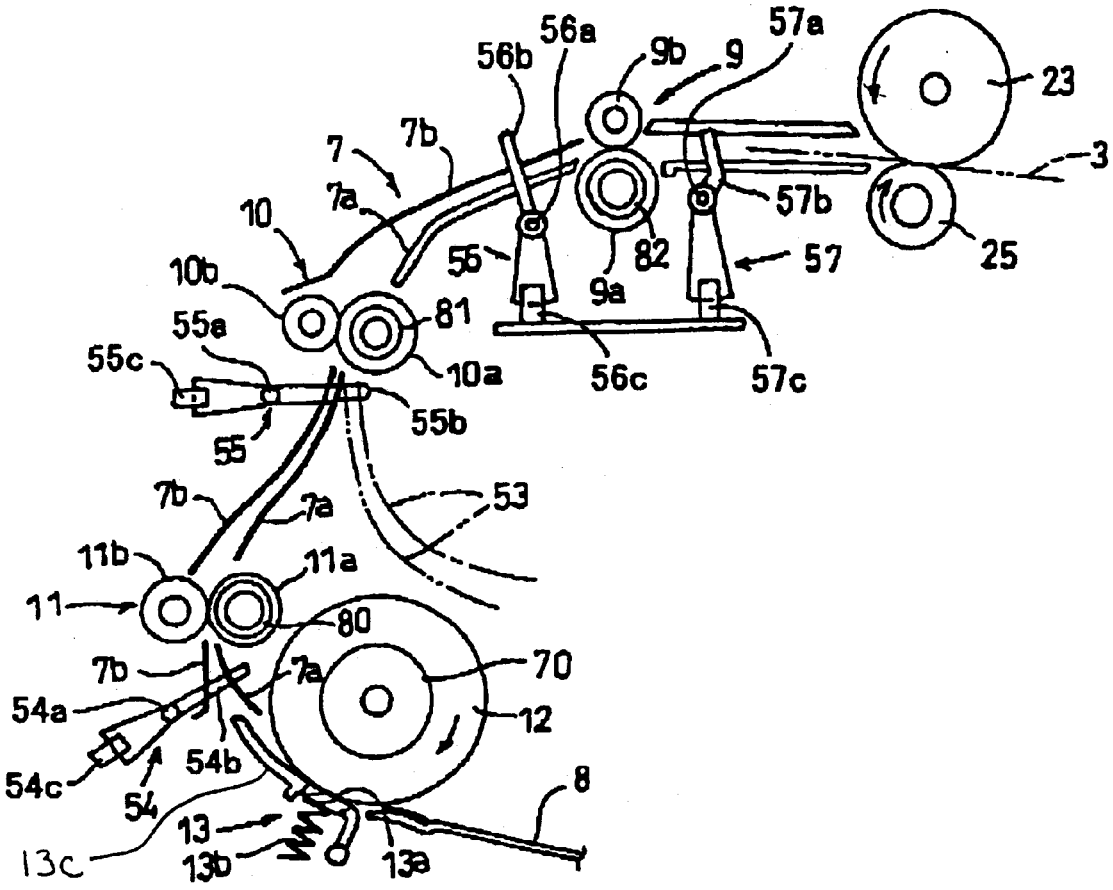
FIG. 2 is a schematic view showing a sheet conveying path and sheet conveying units according to the first embodiment.

A part of the sheet transport passage 7 extending from the sheet supply roller 12 serving as the fourth transport unit to the image forming position will be described with reference to FIG. 2. A pair of curved guide plates 7*a*, 7*b* are provided to define the curved sheet transport passage 7 between the sheet supply position at the uppermost sheet feeder 4 and the image forming position. Each guide plate 7*a*. 7*b* is in facing relation with a major surface of the sheet 3 for guiding a travel of the sheet 3. The third conveying unit 11 including a drive roller 11*a* and a driven roller 11*b* is positioned adjacent to and downstream of the sheet supply roller 12. The second conveying unit 10 including a drive roller 11*a* and a driven roller 10*b* is positioned adjacent to and downstream of the third transport unit 11. The register roller pair 9 serving as the first conveying unit includes a drive roller 9*a* and a driven roller 9*b* and are disposed adjacent to and downstream of the second conveying unit 10. A register roller sensor 56 serving as a first sheet sensor is disposed immediately upstream of the register roller 9, a second sheet sensor 55 is disposed immediately upstream of the conveying rollers 10, and a third sheet sensor 54 is disposed immediately upstream of the conveying rollers 11. An image timing sensor 57 is disposed at immediately downstream of the register roller 9.

Each of the sensors 54, 55, 56, 57 is provided with a pivot shaft 54*a*, 55*a*, 56*a*, 57*a*, a sensor lever 54*b*. 55*b*, 56*b*, 57*b* pivotally supported on the pivot shaft and movable upon abutment of each one end with the leading edge of the sheet, and a fixed detector 54*c*, 55*c*, 56*c*, 57*c* for detecting each position of each another end of the sensor lever 54*b*, 55*b*, 56*b*, 57*b* so as to detect that the leading end of the sheet 3 reaches a predetermined position. A photo-interrupter is available as each detector 54*c*, 55*c*, 56*c*, 57*c*.

The pair of conveying rollers 16 include a drive roller and a driven roller. Further, a fourth sheet sensor (not shown) is disposed immediately upstream of the pair of conveying rollers 16. The fourth sheet sensor has an arrangement the same as that of each sensor 54 through 57.

Figure 3:
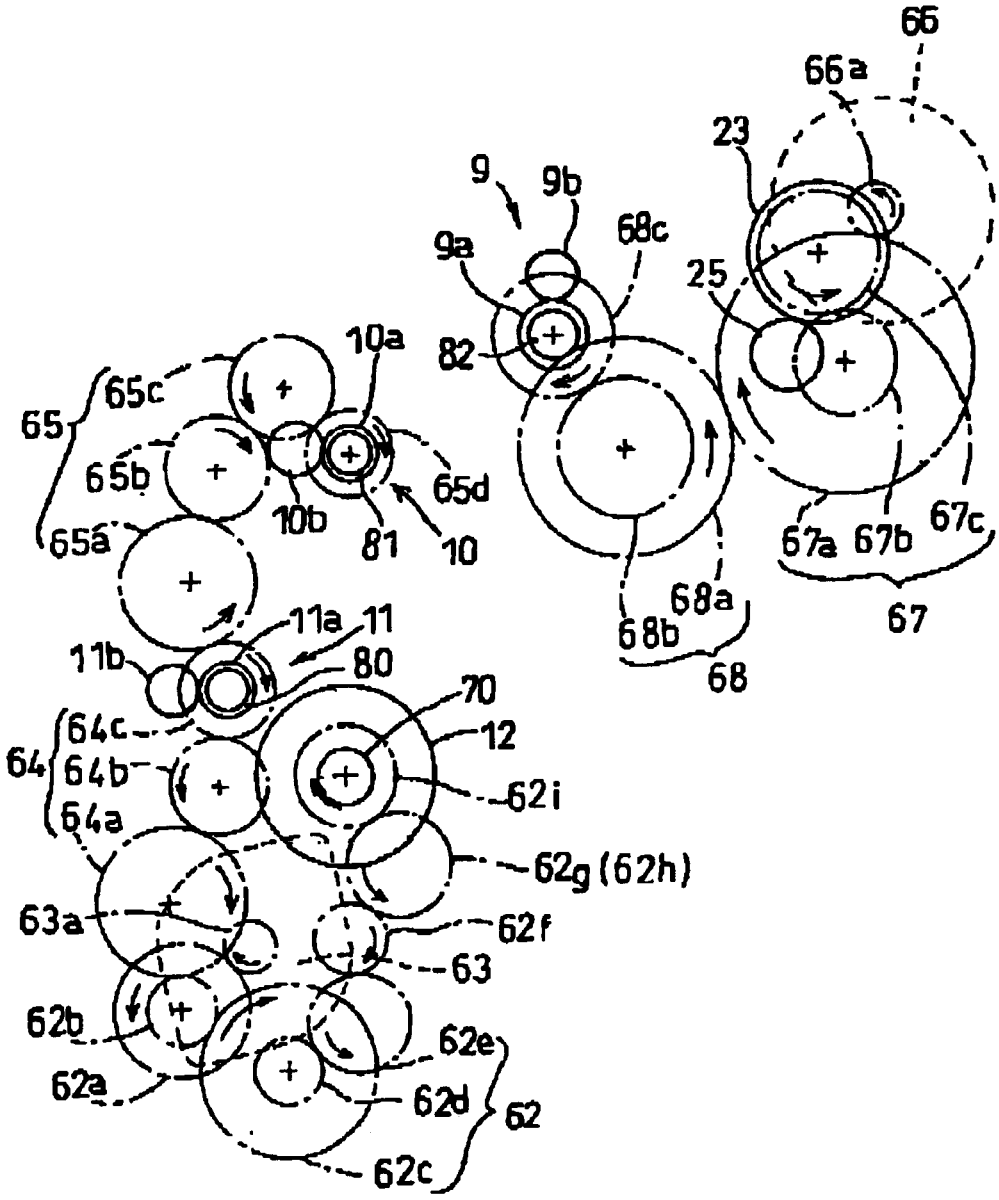
FIG. 3 shows a power transmission mechanism for transmitting driving force to sheet conveying units according to the first embodiment.

FIG. 3 shows a gear train including the drive rollers 9*a*, 10*a*, 11*a* for driving the sheet supply roller 12 and the photosensitive drum 23. The gear train includes a first gear train 62, a second gear train 64, a third gear train 65, a fourth gear train 67, and a fifth gear train 68. The first gear train 62 is adapted for driving the sheet supply roller 12 coaxially provided with a gear wheel 62*i*. A first drive motor 63 is coaxially provided with a pinion gear 63*a*, which is meshedly engaged with a common transmission gear 62*a* provided coaxilly with a common transmission gear 62*b*. The common transmission gear 62*a* is meshely engaged with a gear 62*c* engaged with a gear 62*d* engaged with a gear 62*e* engaged with a gear 62*f* engaged with notched gears 62*g*, 62*h*, and the gear 62*g*, 62*h* are meshedly engaged with the gear wheel 62*i* for driving the sheet supply roller 12.

The second transmission gear train 64 includes a gear 64*a* meshedly engaged with the common gear 62*b*. The gear 64*a* is meshedly engaged with a gear 64*b* engaged with a gear 64*c* provided coaxially with a shaft of the drive roller 11*a* for rotating the drive roller 11*a* in a clockwise direction in FIG. 3. The third gear train 65 is adapted for driving the drive roller 10*a*, and includes a gear 65*a* meshedly engaged with the gear 64*c*. The gear 65*a* is engaged with a gear 65*b* engaged with a gear 65*c* engaged with a gear 65*d* provided coaxially with a shaft of the drive roller 10*a* for rotating the drive roller 10*a* in the clockwise direction in FIG. 3.

A second drive motor 66 having a pinion gear 66*a* is provided for driving the photosensitive drum 23. The fourth gear train 67 includes a gear 67*a* meshedly engaged with the pinion gear 66*a*. The fourth gear train 67 also includes a gear 67*b*, and a gear 67*c* provided coaxially with a drive shaft of the photosensitive drum 23. The fifth gear train 68 is adapted for driving the drive roller 9*a*, and includes a gear 68*a* meshedly engaged with the gear 67*a*. The fifth gear train 68 also includes a gear 68*b* and a gear 68*c* engaged with the gear 68*b* and coaxially with a shaft of the drive roller 9*a* of the register roller 9.

A first clutch 82 is provided in association with the register roller 9 serving as the first conveying unit, and a second clutch 81 is provided in association with the conveying roller 10 serving as the second conveying unit, and a third clutch 80 is provided in association with the conveying roller 11 serving as the third conveying unit. These clutches 82, 81, 80 are electromagnetic clutches. ON state of each electromagnetic clutch provides a power transmission phase, and OFF state of each clutch provides a power disconnection phase where associated drive rollers 9*a*, 10*a*, 11*a* and driven rollers 9*b*, 10*b*, 11*b* are idly rotatable.

The rotation speed of the first and second drive motors 63 and 66, and deceleration ratios of the above described gear trains 62 through 68 and diameters of these rollers 9, 10, 11, 12 are designed to provide the following speed relationship: Provided that a peripheral speed of the photosensitive drum 23, i.e., sheet conveying speed, at the contacting area between the photosensitive drum 23 and the transfer roller 25 is Vo, the register roller (first conveying unit) 9 provides a sheet conveying speed V1 of 15% as high as the conveying speed Vo (V1=1.15V0), the conveying roller (second conveying unit) 10 provides a sheet conveying speed V2 of 15% as high as the conveying speed V1 (V2=1.15V1), the conveying roller (third conveying unit) 11 provides a sheet conveying speed V3 of 15% as high as the conveying speed V2 (V3=1.15V2), and the sheet supply roller (fourth conveying unit) 12 provides a sheet conveying speed Vs of 15% as high as the conveying speed V3 (Vs=1.15V3).

In other words, a downstream side conveying unit provides a sheet conveying speed lower than that of an upstream side conveying unit (V0<V1<V2<V3<Vs) where the image forming position requires the sheet conveying speed V0.

Figure 4:
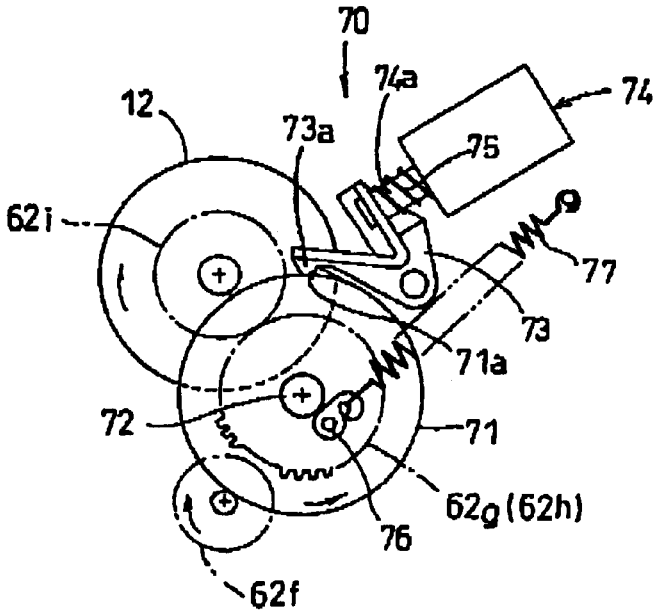
FIG. 4 is a side view showing a clutch for intermittently driving a sheet supply roller in the first embodiment.
Figure 5:
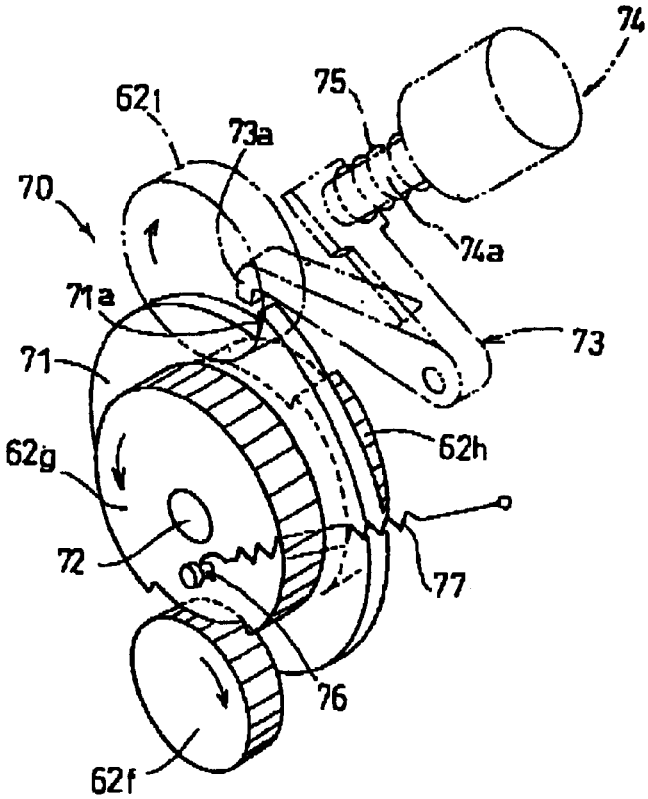
FIG. 5 is a perspective view showing the clutch of FIG. 4.

As shown in FIGS. 4 and 5, a clutch 70 is provided for selectively transmitting driving force to the sheet supply roller 12. The first gear train 62 also includes a cam disk 71 formed integrally between the notched gears 62*g* and 62*h*. The cam disk 71 is provided with an engaging step 71*a*. The notched gears 62*g* and 62*h* and cam disk 71 are fixed on a shaft 72. The notched gear 62*g* is disposed opposite the intermediate gear 62*f* on the driving side, while the notched gear 62*h* opposes the follower-side gear 62*i* provided coaxially with the sheet supply roller 12.

A pivoting engaging lever 73 is capable of contacting or separating from the circumferential surface of the cam disk 71. One end of the engaging lever 73 is linked with a rod 74*a* of an electromagnetic solenoid 74 serving as an actuator. An engaging pawl 73*a* is provided on another end of the pivoting engaging lever 73. The engaging pawl 73*a* is urged toward the circumferential surface of the cam disk 71 by a spring 75 to engage with the engaging step 71*a*. One end of a rotation urging spring 77 is rotatably linked to an eccentric shaft 76 disposed on the side surface of the notched gear 62*g* (or notched gear 62*h*), while the other end of the spring 77 is connected to a frame (not shown). The rotation urging spring 77 functions to urge the notched gears 62*g* and 62*h* and cam disk 71 as a single unit to rotate in the counterclockwise direction of FIG. 4.

Rotation phases of these gears 62*f*, 62*g*, 62*h* and 62*i* are set such that when the engaging pawl 73*a* of the engaging lever 73 engages the engaging step 71*a* of the cam disk 71, stopping the rotation of the cam disk 71, the intermediate gear 62*f* is positioned across from the notched part of the notched gear 62*g* and the teeth of the two gears are disengaged from each other. Similarly, the follower-side gear 62*i* is positioned across from the notched part of the notched gear 62*h*, with the teeth of these two gears disengaged. In this state, the rotational driving force of a first driving motor 63 (see FIG. 3) is not transferred to the follower-side gear 62*i*, enabling the follower-side gear 62*i*, and consequently the sheet supply roller 12, to rotate freely (idle spinning).

Ordinarily, at the beginning of a sheet feed operation, the electromagnetic solenoid 74 is temporarily (intermittently) energized upon receiving a prescribed signal, causing the rod 74*a* to draw into the electromagnetic solenoid 74 against the urging force of the spring 75. At this time, the engaging pawl 73*a* disengages from the engaging step 71*a*. The urging force of the rotation urging spring 77 causes the cam disk 71 and the notched gear 62*g* (notched gear 62*h*) to rotate in the counterclockwise direction of FIGS. 4 and 5, enabling the teeth of the notched gear 62*g* to engage with the intermediate gear 62*f* and transfer its rotational driving force, while the notched gear 62*h* engages with the follow-side gear 62*i*, transferring a rotational force to the sheet supply roller 12. Since the energization of the electromagnetic solenoid 74 is temporary, the engaging pawl 73*a* is maintained in sliding contact with the circumferential surface of the cam disk 71 by the urging force of the spring 75 upon deenergization of the electromagnetic solenoid 74. After the cam disk 71 completes one rotation, the engaging pawl 73*a* is brought into engagement with the engaging step 71*a*, stopping rotational transfer.

In this non-power transmission state, the sheet supply roller 12 can still spin idly. Therefore, when the leading edge of the sheet 3 is conveyed between the pair of intermediate conveying rollers 11 and the like downstream, the sheet 3 is conveyed smoothly downstream, even when the back end of the sheet 3 is interposed between the sheet supply roller 12 and separating pad 13, because of the idle rotation of the sheet supply roller 12.

Figure 6:
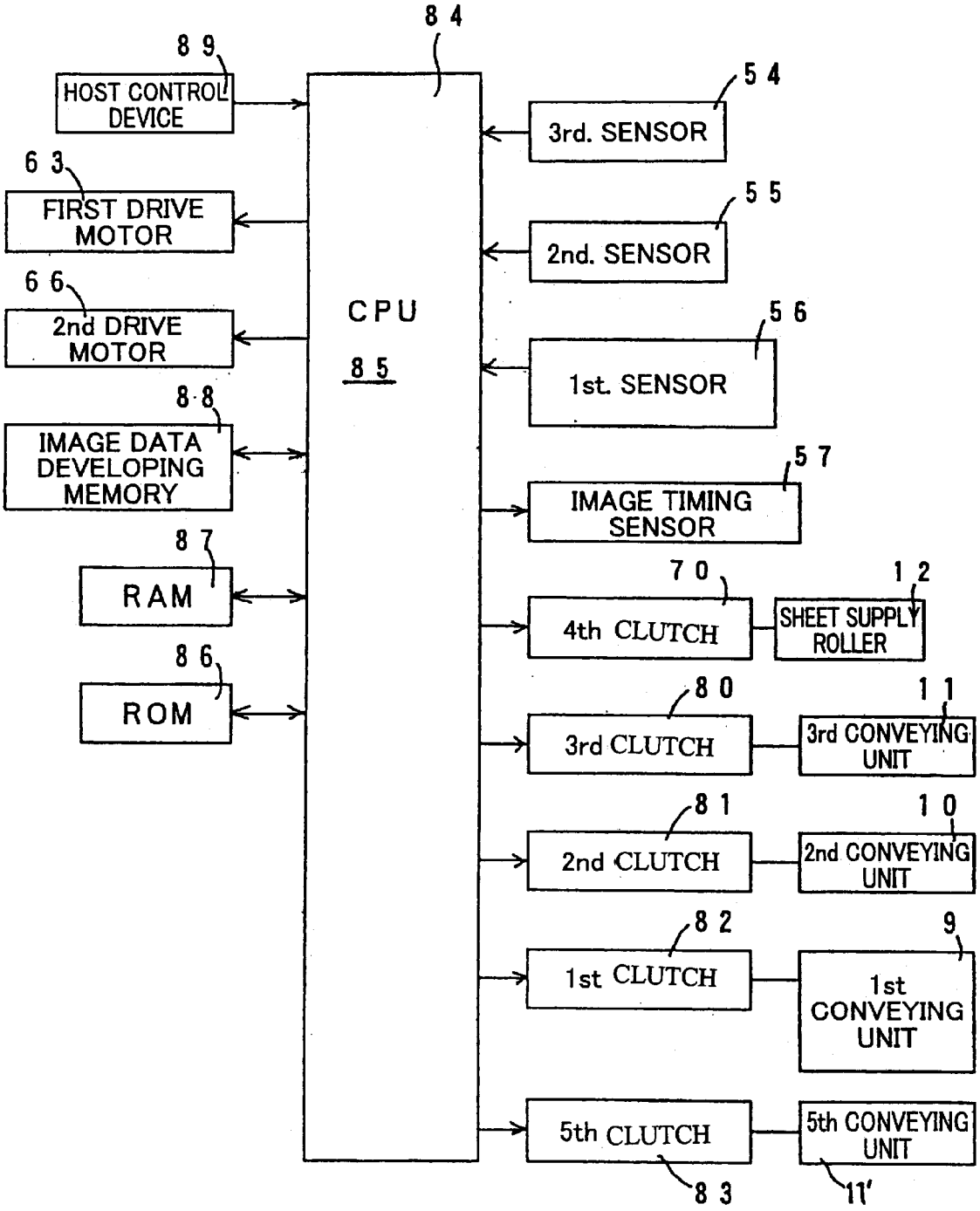
FIG. 6 is a block diagram showing the functions of a controller in the first embodiment.
Figure 7:
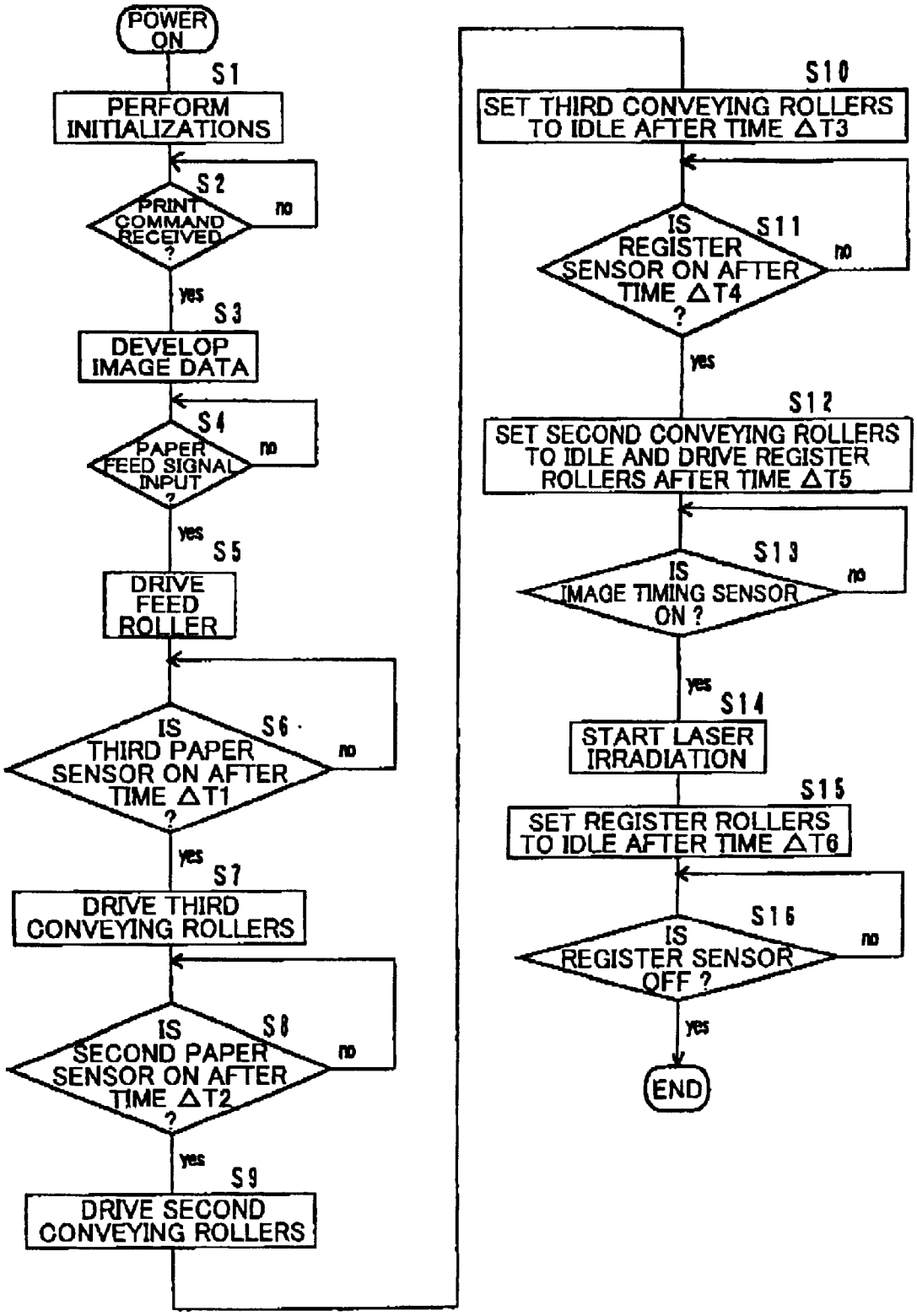
FIG. 7 is a flowchart outlining a control process according to the first embodiment.
Figure 8:
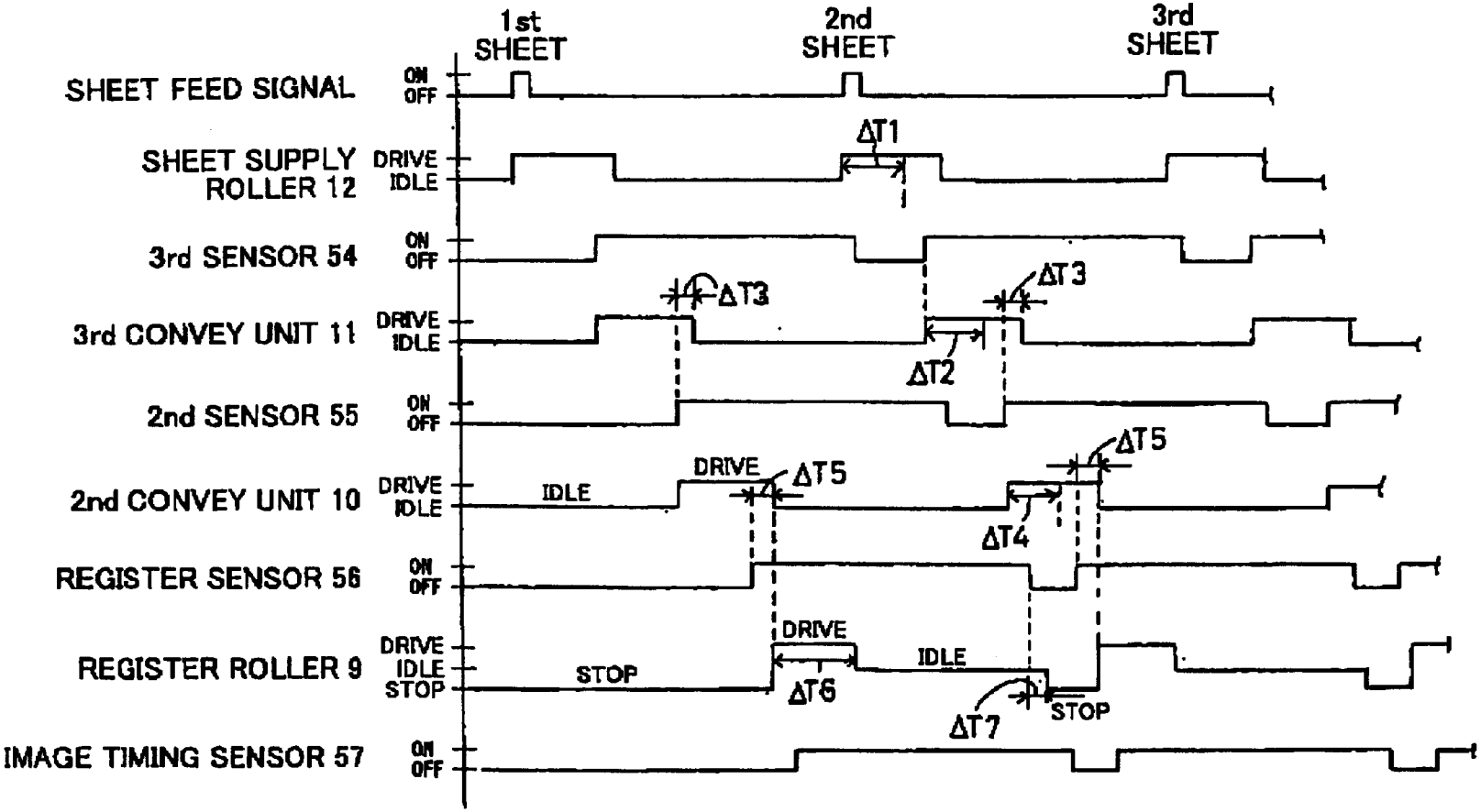
FIG. 8 is a timing chart showing sensing timings of respective sensors and driving timings of respective conveying units according to the first embodiment.

Next, a process for controlling the plurality of conveying units in order to improve the speed for forming images on the sheet 3 will be described. FIG. 6 is a block diagram showing the functions of a controller 84. The controller 84 is an electronic controller, such as a microcomputer. The controller 84 includes a central processing unit (CPU) 85 for executing various calculations in controlling the conveying operations of the register rollers 9, second conveying unit 10, third conveying unit 11, and sheet supply roller 12: a read only memory (ROM) 86 for storing control programs and the like: a random access memory (RAM) 87 for temporarily storing various data; an input/output (I/O) interface (not shown), and the like. Image data, image forming commands, and other data are transmitted from a control device 89, such as a host computer.

The third sheet sensor 54, second sheet sensor 55, first sheet sensor (register sensor) 56, and image timing sensor 57 are connected to the CPU 85 via input interfaces. Detection signals from each sensor are inputted into the CPU 85. External devices in the output system, including the first drive motor 63, the second drive motor 66, the fourth clutch 70 for the sheet supply roller 12, the third clutch 80 for the third conveying unit 11, the second clutch 81 for the second conveying unit 10, and the first clutch 82 for the first conveying unit (register rollers) 9 are connected to the CPU 85 via output interfaces.

Next, the control process for conveying the sheet 3 will be described. First, the case in which only one feeder unit 4 is provided in the printer will be described while referring to the flowchart in FIG. 7 and the timing chart in FIG. 8.

When the power is turned on, various initialization operations are executed in S1. Here, the second drive motor 66 begins operating, driving the photosensitive drum 23, the transfer roller 25, and the developing roller 27 in the processing unit 18 to rotate. In addition, the heat roller 31 in the fixing unit 19 begins rotating and the heater of the beat roller 31 is turned on. In S2, the CPU 85 determines whether a print command has been received from the host computer 89. If a command has been received (Yes in S2), then size data for the sheet 3 to be printed on, such as an A4-size sheet, and image data is transferred. In S3, the image data is sequentially developed into a print data format and stored in the RAM 87.

If the CPU 85 receives a sheet feed signal after a prescribed amount of image data has been developed (Yes in S4), the CPU 85 energizes (turns on) the electromagnetic solenoid 74 for a short period of time and subsequently switches the electromagnetic solenoid 74 to a deenergized state (turns off) to transfer a driving force to the sheet supply roller 12 in S5 for driving the same. By the driving of the sheet supply roller 12, only the topmost sheet of the sheet 3 from the plurality of sheets stacked on the pressure plate 8 Is drawn between the sheet supply roller 12 and separating pad 13*a* and separated from the rest of the stack. The sheet supply roller 12 conveys this single sheet 3 at a velocity Vs, so that the leading edge of the sheet 3 is brought near the third sheet sensor 54 on the conveying path.

After a first prescribed time ΔT1 (see FIG. 8) has elapsed since the sheet feed signal was received, the CPU 85 determines in S6 whether the leading edge of the sheet 3 has pivotally moved the third sheet sensor 54 and turned the sensor 54 from OFF to ON. In estimating the passage of the first prescribed time ΔT1, it is assumed that a prescribed interval exists between the trailing edge of the preceding sheet 3 and the leading edge of the following sheet. Since the third sheet sensor 54 detects the preceding sheet 3 at the point that a sheet feed signal is issued for the following sheet, the first prescribed time ΔT1 is set to a predetermined time greater than or equal to the time required for the preceding sheet 3 to pass the third sheet sensor 54 from the moment the sheet feed signal was issued and within the time required for the sheet to cross the distance corresponding to the interval between sheets (see FIG. 8). When the third sheet sensor 54 maintains ON state after the first prescribed time ΔT1 has elapsed, the CPU 85 assumes that a sheet jam has occurred and the conveying process is interrupted.

If the third sheet sensor 54 is set to ON (Yes in S6), the CPU 85 immediately sets the third clutch 80 to ON to begin driving the conveying rollers (third conveying unit) 11 in S7. After the sheet supply roller 12 conveys the leading edge of the sheet 3 between the drive roller 11*a* and follower roller 11*b*, the conveying rollers 11 convey the sheet 3 toward the conveying rollers (second conveying unit) 10 at a conveying velocity V3 (<Vs). While the conveying rollers 11 convey the sheet 3, the sheet supply roller 12 spins idly, as described above. Accordingly, the back half of the sheet 3 is not restrained by the sheet supply roller 12, enabling the sheet 3 to be conveyed downstream by the driving force of the conveying rollers 11.

After a second prescribed time ΔT2 has elapsed, the CPU 85 determines in S8 whether the leading edge of the sheet 3 has pivotally moved the second sheet sensor 55 and switched the second sheet sensor 55 from OFF to ON. Here, the second prescribed time ΔT2 (see FIG. 8) is preset based on the same reasons given for setting the first prescribed time ΔT1.

That is, at the point in time that the third sheet sensor 54 detects the following sheet 3 and driving of the conveying rollers 11 begins, the second sheet sensor 55 has detected the preceding sheet 3. Therefore, the second prescribed time ΔT2 is set to a predetermined time greater than or equal to the time required for the preceding sheet 3 to pass the second sheet sensor 55 after beginning to drive the conveying rollers 11 and within the time required for the sheet 3 to cross the distance corresponding to the interval between sheets, when the second sheet sensor 55 is ON after the second prescribed time ΔT2 has elapsed, the CPU 85 determines that a sheet jam has occurred and interrupts the conveying process.

As in the process of S6 described above, if the second sheet sensor 55 is ON (Yes in S8), the CPU 85 immediately sets the second clutch 81 to ON in S9, starting the driving of the conveying rollers (second conveying unit) 10. After a prescribed time period from the moment the second sheet sensor 55 is turned on by the leading edge of the sheet 3 until the leading edge of the sheet 3 becomes interposed between the drive roller 10*a* and follower roller 10*b*, that is, after a third prescribed time ΔT3 (see FIG. 8) has been elapsed, the CPU 85 sets the third clutch 80 to OFF in S10, enabling the conveying rollers (third conveying unit) 11 on the upstream end in the conveying direction to spin idly. With this construction, the second conveying rollers 10 convey the sheet 3 to the downstream end (the register rollers 9 side) at a conveying velocity V2 (<V3).

After a fourth prescribed time ΔT4 has elapsed (see FIG. 8), the CPU 85 determines in S11 whether the leading edge of the sheet 3 has contacted the register sensor 56 positioned on the upstream end of the register rollers 9 and turned the register sensor 56 on. Here, the fourth prescribed time ΔT4 is set to a time based on the same reasons for setting the second prescribed time ΔT2.

In S12, after a slight time interval has elapsed from the moment the register sensor 56 was turned on (a fifth prescribed time ΔT5), the CPU 85 turns on the first clutch 82, driving the register rollers 9 to rotate, and turns off the second clutch 81, enabling the second conveying rollers 10 to spin idly. Accordingly, the register rollers 9 convey the sheet 3 toward the image forming position at a conveying velocity V1 (<V2).

The drive roller 9*a* and follower roller 9*b* of the register roller 9 are positioned such that their axes are oriented orthogonal to the conveying path for sheet registering opereation. That is, when the leading edge of the sheet 3 comes into abutment with the drive roller 9*a* and follower roller 9*b*, the front half of the sheet 3 is made to flex slightly so that the leading edge of the sheet 3 can be directed orthogonal to the conveying direction. After the leading edge of the sheet 3 becomes orthogonal to the conveying direction, the CPU 85 drives the drive roller 9*a* to rotate, conveying the leading edge of the sheet 3 between the drive roller 9*a* and follower roller 9*b*. As a result, every sheet can be adjusted into a correct orientation.

When the leading edge of the sheet 3 contacts the image timing-sensor 57 positioned directly downstream from the register rollers 9 in the conveying direction, turning the image timing sensor 57 on (Yes in S13), the CPU 85 controls the scanning unit 17 in S14 to begin irradiating laser light onto the rotating photosensitive drum 23. As a result, an electrostatic latent image based on image data is formed on the photosensitive drum 23. This latent image is formed into a visible image (toner image) by toner supplied on the developing roller 27, and the visible image is brought to the image forming position.

After a sixth prescribed time ΔT6 has elapsed from the moment the image timing sensor 57 is turned on until the sheet 3 becomes interposed between the photosensitive drum 23 and transfer roller 25 (see FIG. 8), the CPU 85 turns off the first clutch 82, enabling the drive roller 9*a* of the register roller 9 to spin idly in S15. Accordingly, the leading edge of the sheet 3 is interposed between the photosensitive drum 23 and transfer roller 25, and the sheet 3 is conveyed at a conveying velocity V0 (<V1). The visible image (toner image) reaching the point of contact between the photosensitive drum 23 and transfer roller 25 (image forming position) is transferred to the surface of the sheet 3.

When the CPU 85 detects that the trailing edge of the sheet 3 has passed the register sensor 56 (Yes in S16), then the trailing edge of the sheet 3 has passed the register rollers 9 after an elapsed seventh prescribed time ΔT7 from the time of the detection in S16 until the trailing edge of the sheet 3 completely passes through the register rollers 9. At this time, the drive roller 9*a* and follower roller 9*b* pressed together at a prescribed pressure are halted.

Based on another control program, the CPU 85 determines whether the operation is complete based on the size of the image data. When image formation is to continue on a plurality of sheets 3, the process is repeated from S4. The timing for issuing a feed signal for the second and subsequent sheets 3 is the time required to convey the trailing edge of the preceding sheet 3 a prescribed distance L downstream from the feeding position.

When forming images consecutively on a plurality of sheets 3, the sheets 3 are fed by the sheet supply roller 12 at a feed start timing to achieve a prescribed distance L (such as 60 mm) between the trailing edge of the preceding sheet 3 and the leading edge of the following sheet 3. The sheets 3 are also conveyed at a conveying velocity Vs. However, when the leading edge of the sheet 3 reaches the third conveying rollers 11 downstream, as described above, the sheet 3 is conveyed at a velocity V3 (<Vs) by the third conveying rollers 11. The sheet supply roller 12 on the upstream end spins idly, thereby enabling the sheet 3 to be conveyed at the conveying velocity V3 without generating slack. By executing operations to reduce the speed, as described above, between the third conveying rollers 11 and second conveying rollers 10, the second conveying rollers 10 and register rollers 9, and the register rollers 9 and the image forming position, while enabling the conveying unit (in which a single sheet 3 passes at any one time) upstream from this position to spin idly, the interval between the trailing edge of the preceding sheet 3 and the leading edge of the following sheet 3 shrinks along the conveying path from the sheet supply roller 12 to the image forming position.

In the first embodiment, the interval between sheets at the sheet supply roller 12 is 60 mm. A sheet interval L0 between the trailing edge of the preceding sheet and the leading edge of the following sheet at the image forming position is set to approximately 10 mm. Assuming the conventional image forming speed is 38 sheets/minute, it is possible to shorten the time period by a time period requiring sheet travel of 50 mm (by shrinking the sheet interval from 60 mm to 10 mm in the present embodiment). Accordingly, the present invention can reduce the image forming time equivalent to 38 sheets×50 mm=1900 mm. Because an A4-size sheet 3 has a lengthwise dimension of 297 mm, the image forming speed can be increased by 1900/297=6.3 sheets/minute, without modifying the peripheral velocity of the photosensitive drum 23.

When the fifth prescribed time ΔT5 has elapsed after the register sensor 56 detects the leading edge of the sheet 3, the second conveying rollers 10 are allowed to spin idly while the register rollers 9 are driven. However, when multiple sheets 3 are printed consecutively, a timer can be provided for counting time from the point at which the register sensor 56 detects that the trailing edge of the preceding sheet 3 has passed until the leading edge of the following sheet 3 is detected. If the time for starting to drive the register rollers 9 is adjusted based on the time counted by this timer, it is possible to compensate for unevenness in the leading edge position of the sheet 3 in the feeding unit to achieve a desired interval between sheets 3. The interval between sheets can also be adjusted by changing the start timing for driving the third conveying rollers 11 or second conveying rollers 10, rather than that for driving the register rollers 9.

Figure 9:
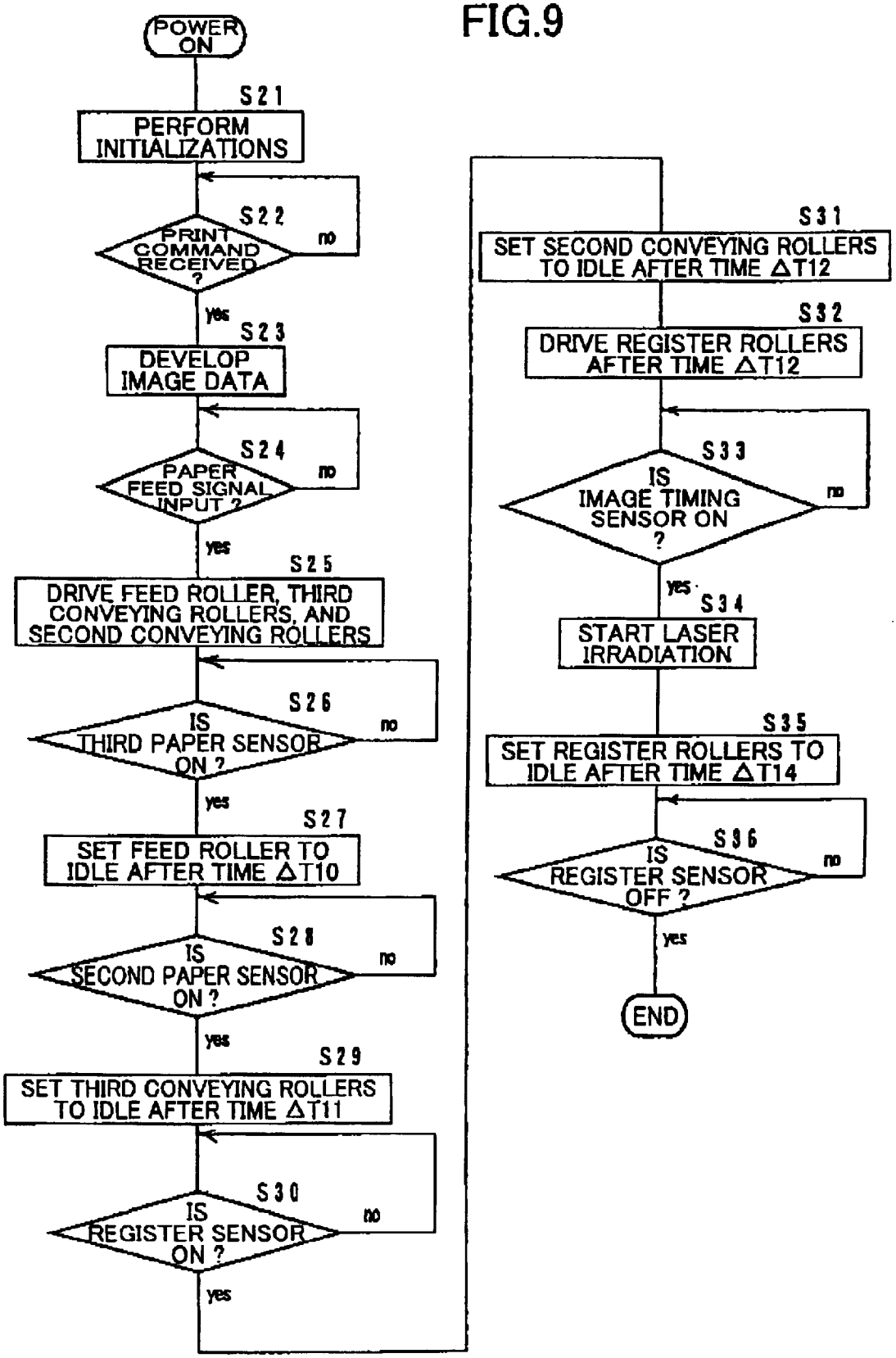
FIG. 9 is a flowchart outlining a control process according to a second embodiment of the present invention.

Next, an image forming device according to a second embodiment will be described with reference to a flowchart in FIG. 9 and a timing chart in FIG. 10. The second embodiment provides a mechanical arrangement similar to that of the first embodiment, whereas a process for controlling conveyance of the sheet 3 is different from that of the first embodiment. In the second embodiment, the clutch for the sheet supply roller 12 is an electromagnetic clutch (not shown) similar to the clutches 80, 81, and 82 in the first embodiment. Accordingly, when each electromagnetic clutch is on, the corresponding clutch is set in a power transmission or coupled state for transferring driving force. When each electromagnetic clutch is off, the corresponding clutch is set in a non-power transmission or decoupled state, and does not transfer driving force, enabling the drive roller and follower roller at the position corresponding to the clutch to spin idly.

When the power is turned on, various initialization operations are executed in S21. Here, the second drive motor 66 begins operating, driving the photosensitive drum 23, the transfer roller 25, and the developing roller 27 in the processing unit 18 to rotate. In addition, the heat roller 31 in the fixing unit 19 begins rotating and the heater of the heat roller 31 is turned on, and the like. In S22, the CPU 85 determines whether a print command has been received from the host computer 89. If a command has been received (Yes in S22), then size data for the sheet 3 to be printed on, such as an A4-size sheet, and image data is transferred. In S23, the image data is sequentially developed into a print data format and stored in the RAM 87.

If the CPU 85 receives a sheet feed signal after a prescribed amount of image data has been developed (Yes in S24), the CPU 85 turns on the clutch of the sheet supply roller 12, the third clutch 80, and the second clutch 81 in S25, driving the sheet supply roller 12, third conveying rollers 11, and second conveying rollers 10 to rotate. As a result, only the topmost sheet of the plurality of the sheet 3 stacked on the pressure plate 8 in the feeder unit 4 is drawn between the sheet supply roller 12 and separating pad 13*a* and separated from the rest of the stack. The sheet supply roller 12 conveys this single sheet 3 at a velocity Vs, so that the leading edge of the sheet 3 is brought near the third sheet sensor 54 on the conveying path.

In S26, the CPU 85 determines whether the leading edge of the sheet 3 has pivotally moved the third sheet sensor 54, causing the third sheet sensor 54 to turn on. If the third sheet sensor 54 Is ON (Yes in S26), then after a tenth prescribed time ΔT10 has elapsed since the third sheet sensor 54 came on (Yes in S26), the CPU 85 switches off the clutch for the sheet supply roller 12 in S27, enabling the sheet supply roller 12 to spin idly. The tenth prescribed time ΔT10 (see FIG. 10) is a conveying time required from the point that the third sheet sensor 54 is turned on by the leading edge of the sheet 3 until the leading edge becomes interposed between the third conveying rollers 11. After the leading edge of the sheet 3 is conveyed to the third conveying rollers 11 and becomes interposed therebetween, the sheet supply roller 12 Is allowed to spin idly, enabling the sheet 3 to be conveyed toward the second conveying rollers 10 at a conveying velocity V3 (<Vs) without hindrance from the sheet supply roller 12.

In S28, the CPU 85 determines whether the leading edge of the sheet 3 has been detected at the second sheet sensor 55 position, that is, whether the second sheet sensor 55 has been turned on. If the second sheet sensor 55 is ON (Yes in S28), the CPU 85 switches off the third clutch 80 in S29 after an eleventh prescribed time ΔT11 (see FIG. 10) has elapsed from the point that the second sheet sensor 55 came on, enabling the third conveying rollers 11 to spin idly. The eleventh prescribed time ΔT11 is the required conveying time from the point that the second sheet sensor 55 is turned on by the leading edge of the sheet 3 until the leading edge reaches an interposing position between the second conveying rollers 10. When the leading edge of the sheet 3 is conveyed to the second conveying rollers 10 becoming interposed therebetween, the third conveying rollers 11 is allowed to spin idly, enabling the sheet 3 to be conveyed toward the register rollers 9 at a conveying velocity V2 (<V3) without hindrance from the third conveying rollers 11.

Similarly, in S30 the CPU 85 determines whether the leading edge of the sheet 3 has been detected at the register sensor 56 position, that is, whether the register sensor 56 has been turned on. In S31, the CPU 85 switches off the second clutch 81 after a twelfth prescribed time ΔT12 has elapsed from the point that the register sensor 56 was turned on (Yes in S30), enabling the second conveying rollers 10 to spin idly. The twelfth prescribed time ΔT12 is the required conveying time period from the point that the register sensor 56 is turned on by the leading edge of the sheet 3 until the leading edge reaches an interposing position between the stopped register rollers 9 whereupon the leading edge becomes registered or aligned. In this way, the sheet 3 can undergo a registering process, as described above, to bring the leading edge flush with the register rollers 9.

After the twelfth prescribed time ΔT12 (see FIG. 10) has elapsed, the CPU 85 drives the register rollers 9 in S32. Accordingly, the leading edge of the sheet 3 is conveyed between the register rollers 9, while the second conveying rollers 10 spin idly, enabling the sheet 3 to be conveyed toward the image forming position at a conveying velocity V1 (<V2) without the back half of the sheet 3 being hindered by the second conveying rollers 10.

When the leading edge of the sheet 3 contacts the image timing sensor 57 positioned directly downstream from the register rollers 9 in the conveying direction, turning the image timing sensor 57 on (Yes in S33), the CPU 85 controls the scanning unit 17 in S34 to begin irradiating laser light onto the rotating photosensitive drum 23 (S34). As a result, an electrostatic latent image based on image data is formed on the photosensitive drum 23. This latent image is formed into a visible image (toner image) by toner supplied on the developing roller 27, and the visible image is brought to the image forming position.

Figure 10:
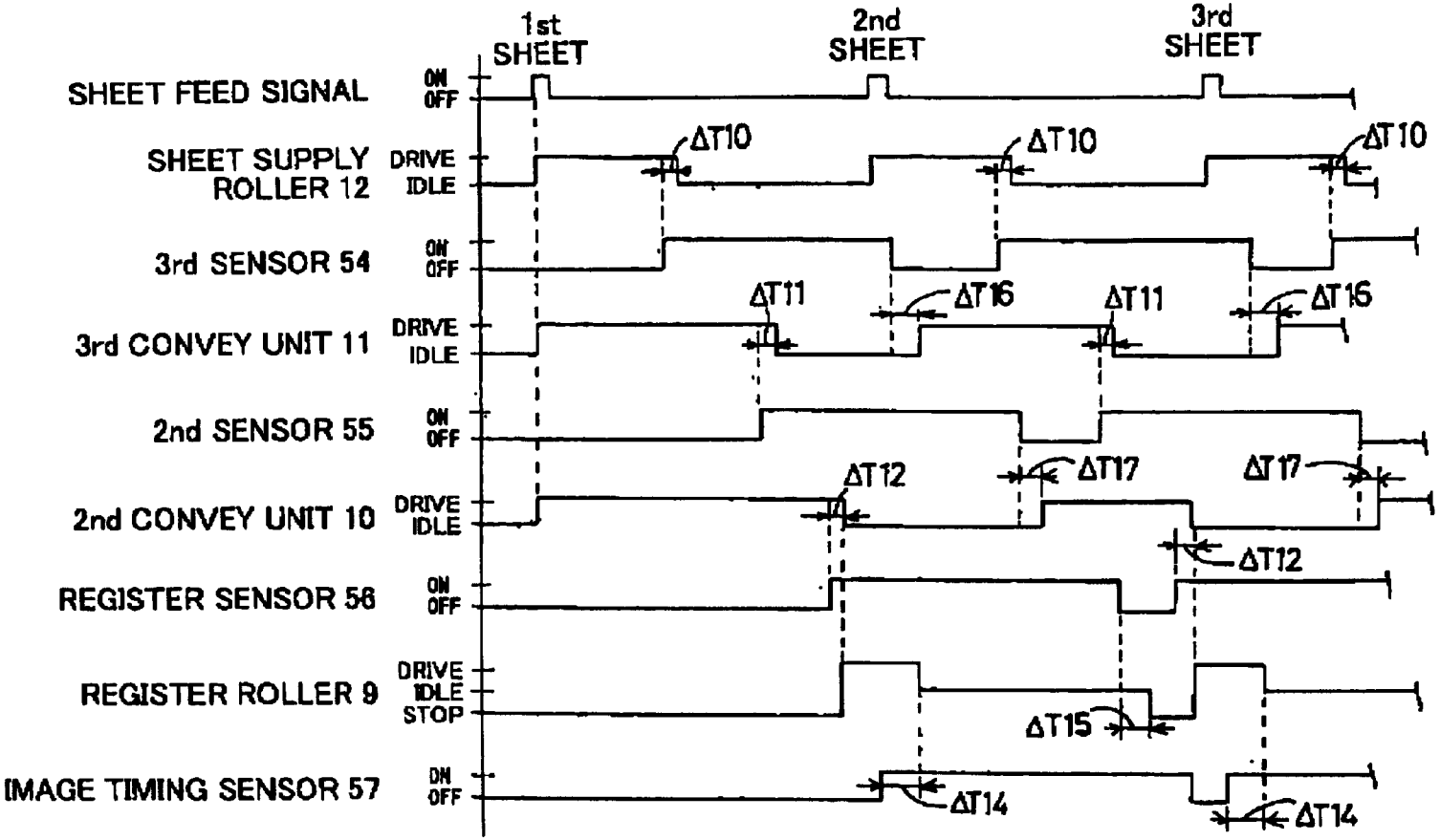
FIG. 10 is a timing chart showing sensing timings of respective sensors and driving timings of respective conveying units according to the second embodiment.

After a fourteenth prescribed time ΔT14 has elapsed from the moment the image timing sensor 57 is turned on (the time required for the leading edge of the sheet 3 to become interposed between the photosensitive drum 23 and transfer roller 25, as shown in FIG. 10), the CPU 85 turns off the first clutch 82, enabling the drive roller 9*a* to spin idly in S35. Accordingly, the leading edge of the sheet 3 is interposed between the photosensitive drum 23 and transfer roller 25, and the sheet 3 is conveyed at a conveying velocity V0 (<V1). The visible image (toner image) reaching the point of contact between the photosensitive drum 23 and transfer roller 25 (image forming position) is transferred to the surface of the sheet 3.

When the CPU 85 detects that the trailing edge of the sheet 3 has passed the register sensor 56 (Yes in S36), then the trailing edge of the sheet 3 has passed the register rollers 9 after an elapsed fifteenth prescribed time ΔT15 (see FIG. 10) from the time of the detection in S36 until the trailing edge of the sheet 3 passes through the register rollers 9. At this time, the drive roller 9*a* and follower roller 9*b* pressed together at a prescribed pressure are halted.

In another control program, the CPU 85 determines whether the printing operation is complete based on the size of the image data. When image formation is to continue on a plurality of sheets 3, the process is repeated from S24.

When printing on the second and subsequent sheets 3, the third conveying rollers 11 are driven again after a sixteenth prescribed time ΔT16 has elapsed from the point that the third sheet sensor 54 was turned off until the trailing edge of the sheet 3 has passed through the third conveying rollers 11. The second conveying rollers 10 are driven again after the passage of a seventeenth prescribed time ΔT17 from the point that the second sheet sensor 55 was turned off until the trailing edge of the sheet 3 has passed through the second conveying rollers 10.

In the control process, it is also possible to begin driving the third conveying rollers 11 and second conveying rollers 10 at the same time as the start of rotation of the sheet supply roller 12 when a feed signal is inputted for feeding the first sheet of the sheet 3. Further, rather than controlling the on/off operations of the clutches 70–82 in the embodiments described above by calculating time counts ΔT1 through ΔT17 based on detection signals when detecting the leading edge or trailing edge of the conveyed sheet 3 with the sheet sensors 54–56 and the image timing sensor 57, it is possible to compute the timings for driving each conveying unit and the timings for allowing the units to spin idly based on size data for the sheet set in the feeding unit and data for the length of the conveying paths from the sheet supply roller 12, serving as the fourth conveying unit, to the third conveying rollers 11, second conveying rollers 10, and register rollers 9.

In the depicted embodiment, the laser printer 1 is provided with two feeder units 4, 4'. If a sheet 3 is fed from the lower feeder unit 4', the sheet 3 is conveyed from a fifth conveying rollers 11' downstream from a lower feed rollers 12' to the third conveying rollers 11. Accordingly, a fifth clutch 83 is provided for the fifth conveying rollers 11', as shown in the block diagram of FIG. 6. The fifth conveying rollers 11' are driven to convey the sheet 3 at a greater conveying velocity than the third conveying rollers 11, while the control operations for the fifth clutch 83 are similar to those described for other clutches in the embodiments above. Further, even if leading edges of the sheets in the feeder unit 4 or 4' are not aligned with one another, a desired interval can be provided between the neighboring sheets by the detection of the trailing edge of the precedent sheet and detection of the leading edge of the subsequent sheet.

In the embodiments described above, the plurality (the number is unrestricted) of conveying units along the conveying path are set to convey the sheet 3 at decreasing velocities in the downstream direction. When the leading edge of the recording medium becomes interposed between a downstream conveying unit, the conveying unit immediately upstream is set to a non-driving state by controlling the clutch for this upstream conveying unit to its disconnection phase. Therefore, when forming images consecutively on a plurality of sheets (recording medium), it is possible to shrink the interval between the trailing edge of a preceding sheet and the leading edge of a following sheet just prior to the image forming position, even though the sheet feed timing results in a wide sheet interval near the feeder unit 4, 4'. Accordingly, time loss caused by a wide sheet interval is minimized, enabling the imaging sheet numbers per unit time in the image forming process to be increased without increasing the peripheral velocity of the photosensitive drum more than the conventional velocity.

Further, the frictional coefficient differs among different types of the sheet 3 and slippage and the like occurs between the sheet 3 and rollers in the conveying units. As a result, the peripheral velocity of the conveying units does not match the conveying speed of the sheet 3. Generally the conveying speed of the sheet 3 is slower than the peripheral speed of the roller. When the timings for turning on and off the clutch and starting the idle spinning of the conveying units are set based on the designed peripheral speed of the conveying units, the sheet can become mis-aligned. In contrast, by providing a sheet detecting device directly upstream from each conveying unit in the present embodiments, clutches can be controlled for setting the conveying unit adjacent to and upstream from the sensor to a non-driving state based on the sensing results, thereby achieving an accurate timing for controlling the conveying units.

Each of the plurality of conveying units is configured of a drive roller and a follower roller that rotates together with the drive roller. It is possible to execute an operation for enabling the drive roller to spin idly by an extremely simple construction by providing respective clutches for the respective drive rollers.

Further, since the clutch is an electromagnetic clutch or other frictional clutch, on/off switching of power to the conveying units can be promptly performed, thereby further increasing printing speed.

Furthermore, the plurality of conveying units are disposed between a sheet feeding position at which sheets of recording medium stacked in the feeding unit are separated and fed one at a time and an image forming position at which an image is formed on the sheet. Further, the conveying units are configured to convey the sheet at a velocity decreasing in the downstream direction from the sheet feed position to the image forming position. Accordingly, the simple construction can result by simply adding clutches to the conventional conveying units disposed along the conveying path.

Further, since the conveying velocities of each conveying unit are set to prevent the trailing edge of a preceding sheet from overlapping the leading edge of a following sheet, the depicted embodiments can prevent the generation of sheet jams along the conveying path.

A demand of high speed image formation, i.e. increase in image carrying sheet numbers per unit period is increasing recently. To meet with this demand, if a peripheral speed of the photosensitive member is increased, a time loss is becoming a typical problem for obtaining predetermined sheet interval. In the depicted embodiment however, it is unnecessary to provide a greater interval between the neighboring sheets, nor to increase peripheral speed of the photosensitive member for the high speed image formation.

An image forming device according to a third embodiment of the present invention will be described with reference to FIGS. 11(*a*) through 14 wherein like parts and components are designated by the same reference numerals and characters as those shown in FIGS. 1 through 10. The third embodiment pertains to the regulation of leading edge position of the sheet in a feeder unit 104.

Similar to the foregoing embodiments, widths of the sheet supply roller 12 and separation pad 13 are smaller in the direction orthogonal to the conveying direction of the sheet 3 than the width of the sheet 3, and the sheet supply roller 12 and the separation pad 13 contact only the approximate widthwise center of the sheet 3.

Figure 11A:
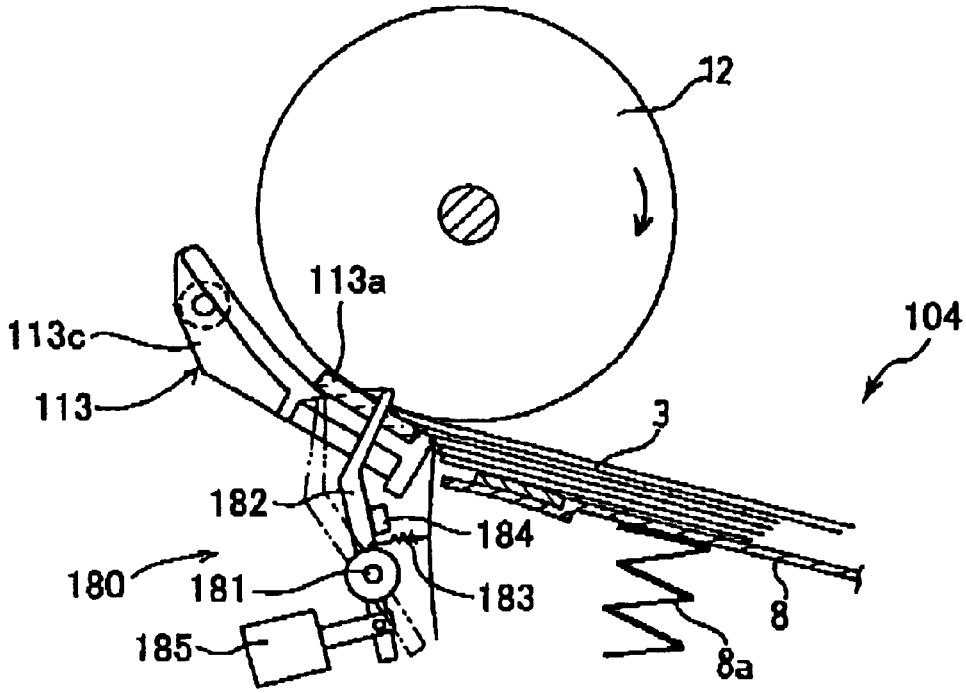
FIG. 11(*a*) is a side view showing a sheet leading edge regulating unit in an image forming device according to a third embodiment of the present invention.
Figure 11B:
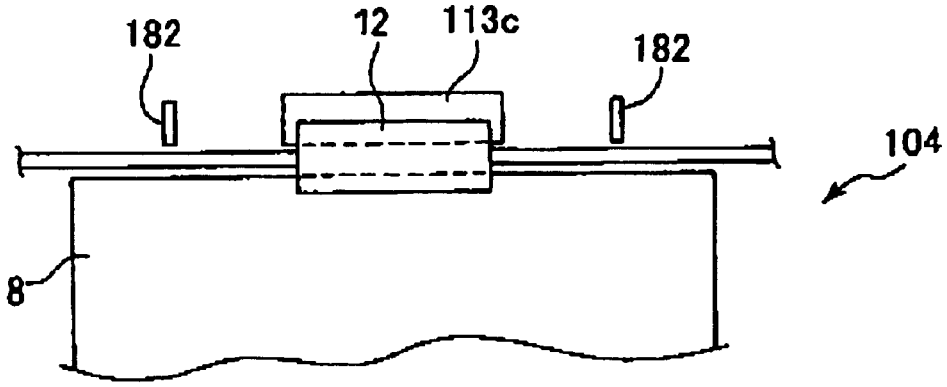

As shown in FIGS. 11(*a*) and 11(*b*), a pair of leading edge regulation unit 180 are disposed on the widthwise left and widthwise right sides of a separating pad 113*a* and sheet supply roller 12, so that free ends of the regulation units 180, 180 can protrude into the sheet conveying path near the sheet separating position defined between the sheet supply roller 12 and pad support 113*c* of the separation unit 113. As best shown in FIG. 11(*a*), each leading edge regulation unit 180 includes a pivot shaft 181 positioned at a stationary position, a regulation lever 182, a biasing spring 183, a stop segment 184 and an actuator 185. The regulation lever 182 is pivotally supported on the pivot shaft 181 and is movable in the sheet conveying direction. The biasing spring 183 is adapted for urging each free end of each regulation lever 182 toward an upstream side in the sheet conveying direction. The stop segment 184 is provided at a fixed position and is adapted to abut against the regulation lever 182 when the free end of the regulation lever 182 protrudes into the sheet conveying path. The actuator 185 is an electromagnetic solenoid that is connected to the regulation lever 182 for urging the free end of the regulation lever in a direction away from the sheet conveying path as shown by a two dotted chain line in FIG. 11(*a*).

Protruding positions of the free ends of the regulation levers 182 into the conveying path are coincident with an upstream end of a nipping area defined between the sheet supply roller 12 and the separation pad 113*a*, so that displacement of the leading edge of the sheet toward the downstream side of the upstream end of the nipping area can be restrained.

Figure 12:
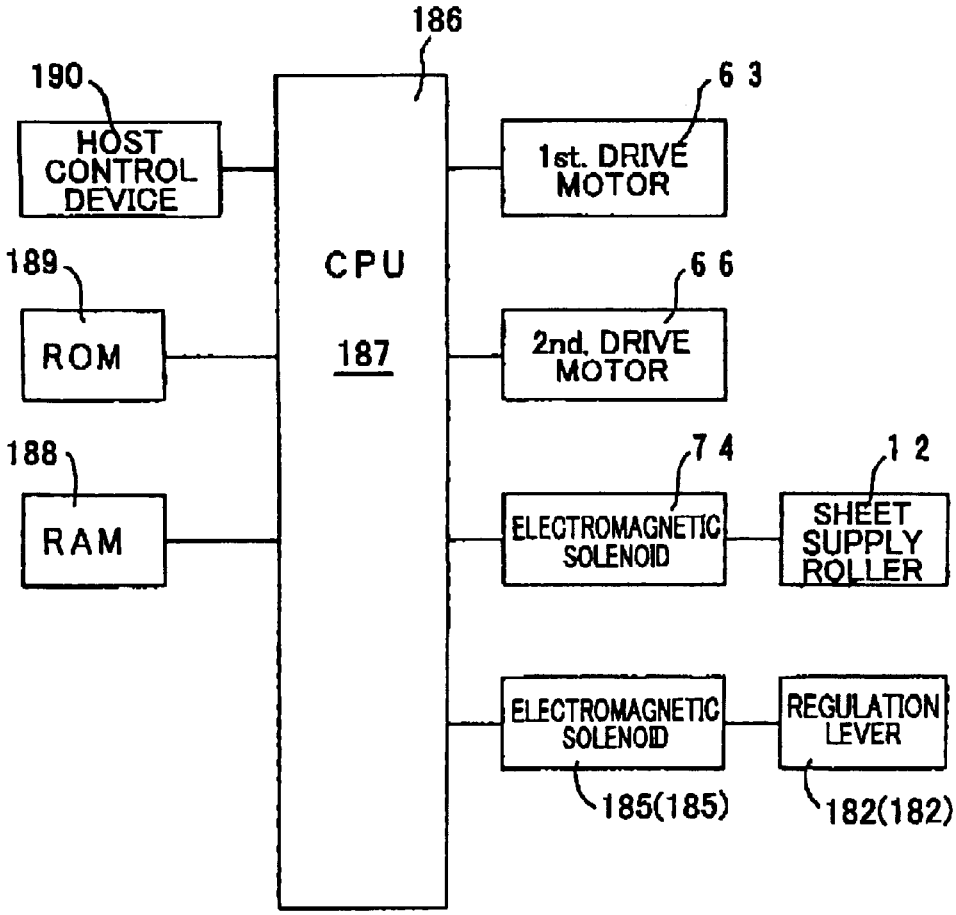
FIG. 12 is a block diagram showing the functions of a controller in the third embodiment.

Leading edge position regulation process by way of the leading edge regulation unit 180 will next be described. FIG. 12 shows a control arrangement for this purpose. An electronic controller, such as a microcomputer is used as a controller 186. The controller 188 includes a central processing unit (CPU) 187 for executing various operations for the sheet leading edge position regulation process. The controller B3 also includes a read only memory (ROM) 187 for storing control programs and the like, a random access memory (RAM) 189 for temporarily storing various data, an input/output (I/O) interface (not shown), and the like. Image data, image forming commands, and other data are transmitted from a master control device 190, such as a host computer.

External output system devices including the first driving motor 63, a second dive motor 66, and the electromagnetic solenoid 74 and the pair of electromagnetic solenoids 185, 185 are connected to the CPU 187 via the output interface (not shown). Similar to the foregoing embodiments, the first driving motor 63 is adapted for driving the sheet supply roller 12 and the intermediate conveying rollers 11, 10 downstream from the sheet supply roller 12. The second drive motor 66 is adapted for driving other mechanisms downstream from the register roller 9 and processing unit 18. The electromagnetic solenoid 74 is adapted for switching the sheet supply roller 12 between driving phase and non-driving phase.

Figure 13:
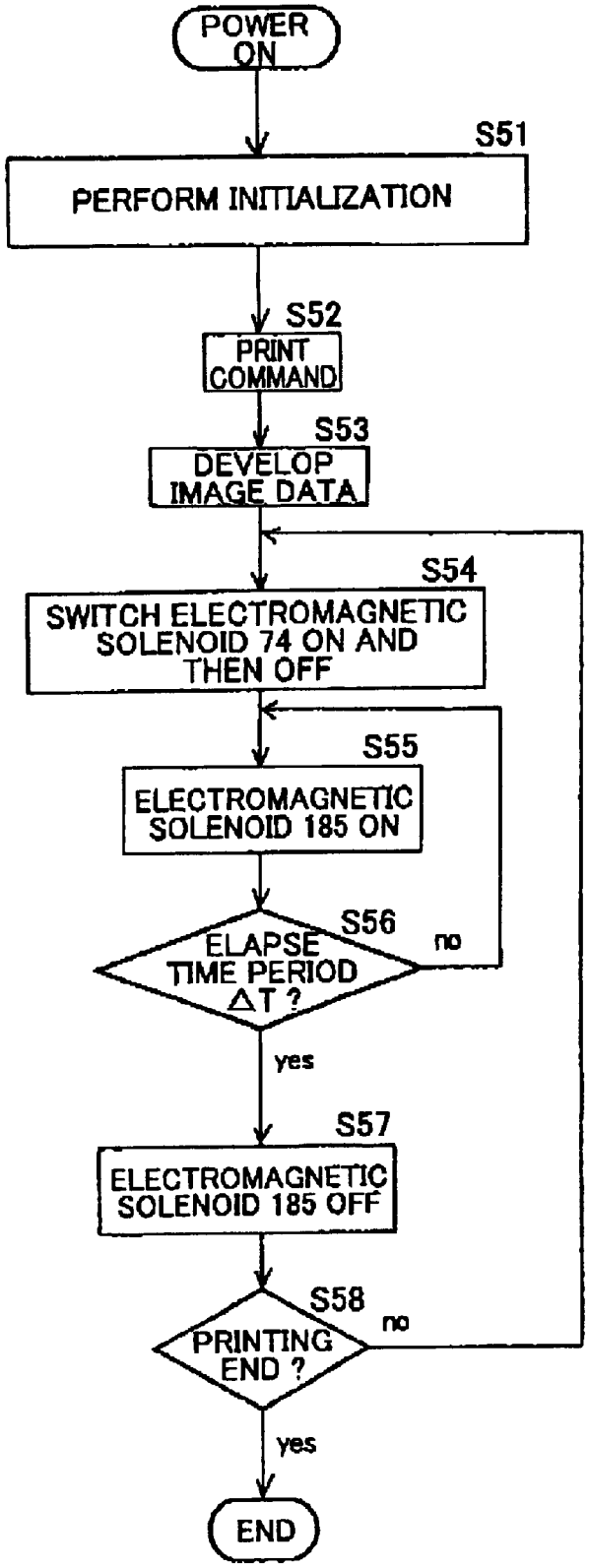
FIG. 13 is a flowchart outlining a control process for controlling leading edge position of the sheet according to the third embodiment.

Next, the process for controlling sheet leading edge position regulation will be described with reference to the flowchart in FIG. 13, when the power is turned on, initial operations are executed in S51. That is, the first driving motor 63, second drive motor 66, and the like began operating, rotating the photosensitive drum 23 and transfer roller 25 in the processing unit 18, the developing roller 27, the heat roller 31, the intermediate conveying rollers 10 and 11, and the like. Further, the heater in the heat roller 31 is also turned on. During these initial operations, the electromagnetic solenoid 74 is set to the deenergization state (OFF) so that motive power of the first driving motor 63 is not transmitted to the sheet supply roller 12. Further, in the initial operation S51, the electromagnetic solenoid 185 is rendered OFF so that the free end of the regulation lever 182 can protrude into the sheet conveying path by the biasing force of the spring 183. Then, after a print command is transferred from the control device 190 to the CPU 187 in S52, image data and size data for the sheet 3 to be printed on, such as data indicating an A4-size sheet of sheet, are transmitted to the CPU 187. As a result, image data is sequentially developed into a printing format and is stored in the RAM 188 in S53.

In S54, the electromagnetic solenoid 74 is switched to the energization phase (ON) and is then switched to the deenergization phase (OFF) in order to transmit a driving force to the sheet supply roller 12. As a result, the sheet supply roller 12 rotates intermittently exactly one rotation, and only the uppermost sheet of the sheet stack on the pressure plate 8 is drawn between the sheet supply roller 12 and separating pad 113*a* and is separated from the rest of the stack. The leading edge of the sheet 3 is then brought into abutment with the free end of the protruding regulation lever 182. Immediately after the abutment, the pair of electromagnetic solenoids 185, 185 are energized (S55) so as to retract the free ends of the regulation levers 182, 182 away from the sheet conveying path against the biasing force of the spring 183, whereupon the sheet 3 can be moved toward the sheet conveying rollers 11. When the leading end portion of the sheet 2 is nipped between the intermediate conveying rollers 11 immediately downstream of the sheet supply roller 12, the sheet supply roller 12 is idly rotated. Therefore, the sheet 3 can be conveyed downstream by the driving force of the intermediate conveying roller 11.

After the step S55, an elapse of a predetermined time period $\Delta T$ is judged (S56), and the electromagnetic solenoids 185, 185 are deenergized (S57) immediately after the trailing end of the sheet 3 moves past the sheet supply roller 12 and the separation pad 113*a*. Accordingly, the free ends of the regulation levers 182, 182 again protrude into the sheet conveying path. Therefore, the leading edge of the subsequent sheet can abut the regulation levers 182, 182, even if the subsequent sheet is urged in the downstream direction due to frictionally absorbing force by the running precedent sheet, consequently, large downstream side displacement of the leading edge away from the nipping area between the sheet supply roller 12 and the separation pad 113*a* can be prevented. In other words, unwanted reduction in the interval between the trailing edge of the precedent sheet and the leading edge of the subsequent sheet can be eliminated, but a proper interval can be maintained. As a result, paper feed start timing can be set with a proper time interval, thereby increasing printing processing speed (printing sheet numbers per a minute). In other words, it is unnecessary to provide a prolonged time interval (which causes lower print processing speed) for the sheet supply timing in an attempt to provide a sufficient time period for image data development and for avoiding mistaking judgment as to sheet jamming.

Then, judgment is made as to whether or not the printing process is terminated based on the size of the image data (S58). If there are remaining image data (S58: No), the routine returns to S54 and the control is repeated until the printing process is terminated. When the printing process is terminated (S58: Yes), the routine is ended. Energization (ON) and deenergization (OFF) timings of the electromagnetic solenoids 74 and 185, and driving (ON) and non-driving (OFF) timing of the sheet supply roller 12 in connection with the steps S54 to S58 are shown in a timing chart of FIG. 14.

In the third embodiment, proper image formation can be performed on the sheet 3 at a proper area of the sheet since a proper sheet interval can be provided by the regulation of the leading edge position. Further, printing processing speed can be increased since sheet supply start timing can be correctly provided.

Figure 14:
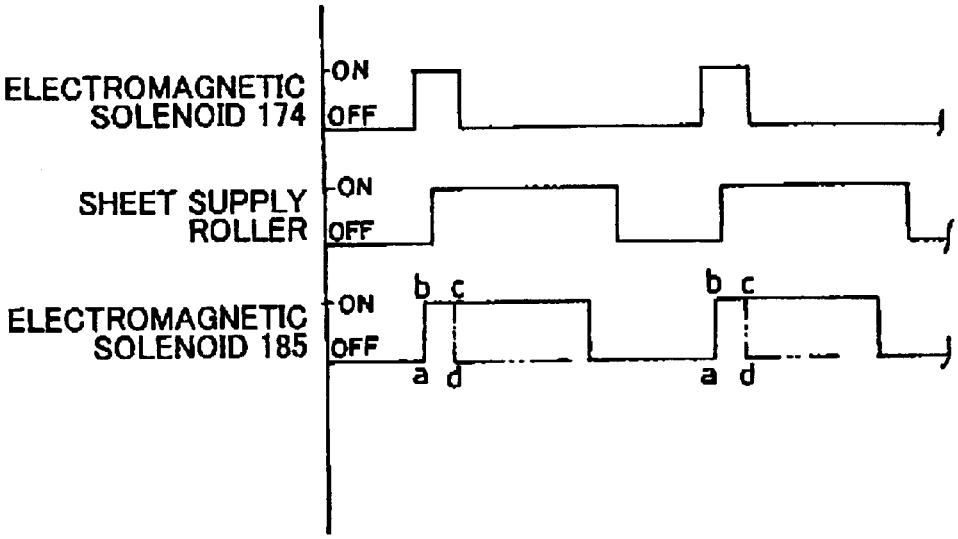
FIG. 14 is a timing chart showing the relationship between sheet conveying timing and leading edge position regulation timing according to the third embodiment and according to a modification thereto.

As a modification to the third embodiment, ON state duration of the electromagnetic solenoids 185 can be shortened with an order of a–b–c–d as shown by a dotted line in FIG. 14 when the free ends of the regulation levers 182 are moved from their retracted positions to their protruding positions as long as the regulation levers 182 do not interfere the travel of the leading edge of the precedent sheet.

In the third embodiment, the sheet leading edge position regulating unit 180 is operated in timed relation to the sheet separation timing by the separation unit 113 so as to permit the sheet to be moved. Therefore, the precedent sheet can be desirably fed upon desirable separation from the remaining sheet stack.

Moreover, the sheet leading edge position regulating unit 180 can be promptly moved between the regulating position and the non-regulating position because of the employment of the electromagnetic clutch, the subsequent sheet can surely be subjected to regulation of the leading edge position.

Further, the leading edge of the subsequent sheet can undergo regulation without fail by the regulation unit 180, because the regulation is performed at the upstream end of the nipping area between the sheet supply roller 12 and the separation pad 113*a*.

Furthermore, the sheet leading edge position regulating units 180, 180 are positioned symmetrically with respect to the sheet supply roller 12, that is, the regulation units 180, 180 are positioned symmetrically beside the sheet supply roller 12 in the widthwise direction of the sheet 3, the widthwise direction being perpendicular to the sheet conveying direction. With this arrangement, the leading edge of the sheet can be regulated in a direction perpendicular to the sheet conveying direction. This implies that the sheet can be oriented in a direction such that the leading edge of the sheet is directed perpendicular to the conveying direction when the regulation units disengage from the leading edge. Consequently, diagonal feeding of the sheet can be avoided.

Thus, the above-described embodiments can provide an image forming device capable of reducing time loss attendant to the provision of the sheet interval, and increasing image forming sheet numbers per a unit period. Further, the above described embodiment can provide an image forming device capable of forming images at an appropriate position on a recording medium, while maintaining a fast processing speed. While the invention has been described in detail with reference to specific embodiments thereof, it would be apparent to those skilled in the art that various changes and modifications may be made therein without departing from the spirit and scope of the invention. For example, the sheet supply roller 12 in the embodiments described above can be shaped like the letter D from a side perspective, with a sheet conveying arcuate surface and a non-conveying linear surface. Further, the embodiments described above employ a frictional separating type feeding unit in which a frictional separating pad formed of a material having a high coefficient of friction is positioned in opposition to the circumferential surface of the sheet supply roller 12. However, the present invention can also be applied to a feeding unit having a bank-type separating mechanism. In the latter feeding unit, a sheet supply roller is placed in contact with an uppermost sheet of the sheet stack, and a bank member is positioned approximately orthogonal to the sheet conveying path for blocking the sheet. When the sheet supply roller is driven to rotate, the uppermost sheet can ride over the bank member by making use of linear orientation nature of the sheet after flexure.

Further, the embodiments described above pertain to a laser printer 1. However, the present invention can also reduce time loss caused by large intervals between consecutively conveyed sheets and can increase the sheets per minute rate in the image forming process without having adverse effects on the printing quality when using a color laser printer, inkjet printer, thermal printer, dot impact printer, or the like. Further, the photosensitive drum 23 is used as the photosensitive member in the embodiments described above, but a photosensitive belt may also be used. While the transfer roller 25 is used for the transfer process, a corona discharge system may also be used. In addition, the conveying speeds of the multipurpose feed roller 15*a*, conveying rollers 16, and register roller toward the downstream direction of the conveying path are exemplary.

What is claimed is:

1. An image forming device for forming an image on a cut image recording medium comprising:

a drive source;

a sheet feeder unit storing therein a stack of image recording mediums;

an image forming unit at which a visible image is formed on the image recording medium;

a sheet conveying path extending between the sheet feeder unit and the image forming unit, each image recording medium being conveyed through the sheet conveying path in a conveying direction from the sheet feeder unit to the image forming unit;

at least two sheet conveying units connected to the drive source and including a downstream side sheet conveying unit and an upstream side sheet conveying unit, the downstream side sheet conveying unit being disposed along the conveying path for conveying the image recording medium at a first conveying speed, and the upstream side sheet conveying unit being disposed along the conveying path and upstream of the downstream side sheet conveying unit in the conveying direction for conveying the image recording medium at a second conveying speed higher than the first conveying speed; and at least two clutches including a first clutch and a second clutch, the first clutch being connected between the drive source and the downstream side sheet conveying unit and providing a power connection state for driving the downstream side sheet conveying unit and a power disconnection state for shutting off power transmission to the downstream side sheet conveying unit, and the second clutch being connected between the drive source and the upstream side sheet conveying unit and providing a power connection state for driving the upstream side sheet conveying unit and a power disconnection state for shutting off power transmission to the upstream side sheet conveying unit; and a controller controlling the at least two clutches so as to provide the disconnection state in the upstream side sheet conveying unit when the downstream side sheet conveying unit holds a leading edge portion of the image recording medium.

2. The image forming device as claimed in claim 1, wherein the sheet feeder unit comprises a sheet supply roller providing a third sheet conveying speed higher than the second sheet conveying speed.

3. The image forming device as claimed in claim 1, wherein the controller comprises stopping means for stopping driving operation of at least the downstream side sheet conveying unit so that the leading edge of the image recording medium abuts against the stopped downstream side sheet conveying unit for adjusting an interval between a trailing edge of a precedent image recording medium and a leading edge of the subsequent image recording medium.

4. The image forming device as claimed in claim 3, wherein the downstream side sheet conveying unit comprises a register roller extending perpendicular to the sheet feeding direction.

5. The image forming device as claimed in claim 1, further comprising a sheet sensor connected to the controller and disposed along the sheet conveying path and between the downstream side sheet conveying unit and the upstream side sheet conveying unit for generating a sheet detection signal when the image recording medium passes through the sheet sensor;

wherein the controller comprises means for shifting the second clutch to its power disconnection state when the sensor generates the sheet detection signal.

6. The image forming device as claimed in claim 5, wherein the controller comprises means for shifting the first clutch to its power disconnection state and then to its power connection state for controlling a stopping period of a subsequent image recording medium based on a detection of the trailing edge of the precedent image recording medium and a detection of the leading edge of the subsequent image recording medium by the sheet sensor.

7. The image forming device as claimed in claim 1, wherein the downstream side sheet conveying unit comprises a first drive roller connected to the first clutch, and a first follower roller rotatable with the rotation of the first drive roller; and wherein the upstream side sheet conveying unit comprises a second drive roller connected to the second clutch, and a second follower roller rotatable with the rotation of the second drive roller.

8. The image forming device as claimed in claim 1, wherein each of the first clutch and the second clutch comprises a friction clutch.

9. The image forming device as claimed in claim 8, wherein each friction clutch comprises an electromagnetic clutch.

10. The image forming device as claimed in claim 1, wherein the sheet feeder unit comprises a sheet cassette for stacking therein a plurality of the image recording medium and provides a sheet supplying position where an uppermost image recording medium is separated from a remaining stack, and wherein the image forming unit provides an image forming position, the at least two sheet conveying units being positioned between the sheet supplying position and the image forming position.

11. An image forming device for forming an image on a cut image recording medium comprising:

a drive source providing a driving force;

a sheet feeder unit comprising a sheet storing portion in which a plurality of image recording mediums are stacked in a sheet stack, and a sheet supply roller for separating one image recording medium from a remaining sheet stack and for feeding the separated image recording medium in a sheet feeding direction;

an image forming unit at which a visible image is formed on the image recording medium, the image forming unit comprising a photosensitive member carrying an electrostatic latent image where developing agents are carried as a developing agent image, and a transfer roller for transferring the developing agent image onto the image recording medium;

a sheet conveying path extending between the sheet feeder unit and the image forming unit, each image recording medium being conveyed through the sheet conveying path in the sheet feeding direction from the sheet feeder unit to the image forming unit;

a first sheet conveying roller disposed along the conveying path and between the sheet supply roller and the transfer roller, the first sheet conveying roller providing a peripheral speed lower than that of the sheet supply roller and higher than that of the transfer roller;

a first clutch connected to the first sheet conveying roller for selectively transmitting the driving force of the drive source to the first sheet conveying roller, the first clutch providing a power connection phase for driving the first sheet conveying roller and providing a power disconnection phase for stopping the first sheet conveying roller;

a second clutch connected to the sheet supply roller for selectively transmitting the driving force of the drive source to the sheet supply roller, a sensor positioned adjacent to the first sheet conveying roller for detecting a trailing edge of an image recording medium; and a controller comprising:

shut-off means that provides the power disconnection phase after the trailing edge of a precedent image recording medium is moved past the first sheet conveying roller as a result of a detection of the trailing edge by the sensor, so that a leading edge of a subsequent image recording medium abuts the stopped first sheet conveying roller for regulating an interval between the trailing edge of the precedent sheet and the leading edge of the subsequent sheet; and drive start means that provides the power connection phase of the first clutch for starting driving rotation of the first sheet conveying roller after the regulation of the interval based on the time period elapsed from the detection timing of the sensor.

12. The image forming device as claimed in claim 11, wherein the second clutch provides a power connection phase for driving the sheet supply roller and providing a power disconnection phase for shutting off power transmission from the drive source to the sheet supply roller; and the image forming device further comprising:

a second sheet conveying roller disposed along the sheet conveying path and between the sheet supply roller and the first sheet conveying roller, the second sheet conveying roller providing a peripheral speed lower than that of the sheet supply roller and higher than that of the first sheet conveying roller;

a third clutch connected to the second sheet conveying roller for selectively transmitting the driving force of the drive source to the second sheet conveying roller, the third clutch providing a power connection phase for driving the second sheet conveying roller, and providing a power disconnection phase for shutting off power transmission from the drive source to the second sheet conveying roller; and wherein the controller further comprises:

second shut-off means that provides the power disconnection phase of the second clutch when a leading edge of an image recording medium is held by the second sheet conveying roller;

third shut-off means that provides the power disconnection phase of the third clutch when the leading edge of the image recording medium is held by the first sheet conveying roller; and fourth shut-off means that provides the power disconnection phase of the first clutch when the leading edge of the image recording medium is held between the photosensitive member and the transfer roller.

* * * * *